US009441626B2

(12) United States Patent
Patterson et al.

(10) Patent No.: US 9,441,626 B2
(45) Date of Patent: Sep. 13, 2016

(54) OVAL CHAMBER VANE PUMP

(71) Applicant: WindTrans Systems Ltd, Seaforth (CA)

(72) Inventors: Dan Patterson, Seaforth (CA); Andrew Masse, Seaforth (CA)

(73) Assignee: WindTrans Systems Ltd, Seaforth (CA)

( * ) Notice: Subject to any disclaimer, the term of this patent is extended or adjusted under 35 U.S.C. 154(b) by 5 days.

(21) Appl. No.: 13/830,242

(22) Filed: Mar. 14, 2013

(65) Prior Publication Data

US 2013/0202468 A1 Aug. 8, 2013

Related U.S. Application Data

(63) Continuation-in-part of application No. 13/710,331, filed on Dec. 10, 2012.

(60) Provisional application No. 61/695,635, filed on Aug. 31, 2012, provisional application No. 61/729,373, filed on Nov. 22, 2012.

(51) Int. Cl.
*F01C 21/08* (2006.01)
*F04C 2/344* (2006.01)
(Continued)

(52) U.S. Cl.
CPC ..... *F04C 2/04* (2013.01); *F01C 21/0818* (2013.01); *F01C 21/0836* (2013.01); *F04C 2/3442* (2013.01); *F04C 2/3445* (2013.01); *F04C 15/0061* (2013.01); *F04C 2250/30* (2013.01)

(58) Field of Classification Search
CPC ..... F01C 21/0836; F01C 21/352; F01C 21/0818; F04C 2/3445; F04C 2/3442; F04C 2250/30; F04C 15/0061
USPC ..... 418/143, 257, 253, 259, 265–268
See application file for complete search history.

(56) References Cited

U.S. PATENT DOCUMENTS 502,890 A * 8/1893 Reichhelm ..... 418/265
902,878 A * 11/1908 Hayton ..... 418/253
(Continued)

FOREIGN PATENT DOCUMENTS

CA 2421188 A1 3/2003
JP 1100397 7/1989
WO WO-/2012/079144 2/2012

OTHER PUBLICATIONS

International Search Report for Application No. PCT/CA2012/001135 dated Mar. 20, 2013.
(Continued)

*Primary Examiner* — Nicholas J Weiss
*Assistant Examiner* — Wesley Harris
(74) *Attorney, Agent, or Firm* — Honigman Miller Schwartz and Cohn LLP

(57) ABSTRACT

A rotary device for use with a fluid, having a housing, a rotor, and a vane having a respectively associated wiper. The housing has a tubular surface defining in part a tubular volume, the tubular volume segregated into at least a pumping zone and a working zone. The rotor is mounted for rotation and has a body mounted within the tubular volume and a plurality of slots. Each slot extends at least generally radially from the axis. Each vane is mounted at least partially within each slot. As the rotor rotates, each vane rotates within the tubular volume and extends and retracts within the tubular volume. The wiper contacts the tubular volume of the housing while the respectively associated vane rotates through the pumping zone, and wherein the wiper does not contact the tubular volume of the housing while the respectively associated vane rotates through the working zone.

21 Claims, 39 Drawing Sheets

(51) Int. Cl.
*F04C 15/00* (2006.01)
*F04C 2/04* (2006.01)

(56) References Cited

U.S. PATENT DOCUMENTS 1,237,273 A * 8/1917 Baade ..... F01C 21/0836 418/264
4,073,608 A * 2/1978 Christy ..... 418/241
4,397,621 A * 8/1983 Pickard et al. ..... 418/236
5,899,677 A 5/1999 Ono et al.
6,659,067 B1 12/2003 Al-Hawaj
7,229,262 B2 * 6/2007 Patterson ..... 418/133
2008/0240935 A1 10/2008 Dong

OTHER PUBLICATIONS

International Search Report for PCT/CA2014/000192 dated Jul. 7, 2014.

* cited by examiner

OVAL CHAMBER VANE PUMP

CROSS REFERENCE TO RELATED APPLICATIONS

This U.S. patent application is a continuation-in-part of, and claims priority under 35 U.S.C. §120 from, U.S. patent application Ser. No. 13/710,331, filed on Dec. 12, 2012, which claims priority to U.S. provisional application 61/695,635 filed Aug. 31, 2012 and U.S. provisional application 61/729,373 filed Nov. 22, 2012 and Canadian application 2764669 filed Jan. 16, 2012 and Canadian application 2796484 filed Nov. 22, 2012. The disclosure of the prior application is considered part of the disclosure of this application and is hereby incorporated by reference in its entirety.

TECHNICAL FIELD

The invention relates to the field of rotary devices, such as pumps.

BACKGROUND

A vane pump consists of vanes mounted to a rotor that rotates inside a cavity. These vanes can be of variable length and/or tensioned to maintain contact with the cavity wall as the pump rotates.

SUMMARY

One aspect of the disclosure provides a rotary device for use with a fluid. The device includes a housing, a rotor, and a vane. The housing has a tubular surface that defines in part a tubular volume. The tubular volume is segregated into at least a pumping zone and a working zone. The rotor is mounted for rotation about a rotation axis. The rotor has a body that is mounted within the tubular surface and a plurality of slots. Each slot extends at least generally radially from the axis. The vane is mounted at least partially within each slot. As the rotor rotates, each vane rotates within the tubular volume and extends and retracts within the tubular volume. Additionally, each vane has a respectively associated wiper that is disposed on an end of the vane. The wiper contacts the tubular surface of the housing while the respectively associated vane rotates through the pumping zone, and where the wiper does not contact the tubular surface of the housing while the respectively associated vane rotates through the working zone.

Implementations of the disclosure may include one or more of the following features. In some implementations, as each vane approaches the pumping zone, a wiper distance decreases reaching zero at the pumping zone, and the wiper distance increases as each vane leaves the pumping zone. The wiper distance is the distance from a wiper to the tubular surface. Additionally, the housing may define an oval track. For each vane, a track follower may be connected to the vane and may traverse the track. The track follower controls the wiper distance from the tubular surface. In some examples, the oval track is at a distance from the tubular surface. The distance is at a maximum distance when the oval track is in the pumping zone.

In some implementations, the pumping zone is defines by adjacent pairs of vanes, the rotor and the tubular surface define at least in part the pumping zone, the pumping zone having a constant volume. Each vane may extend and retract along a translation axis defined by the slot for which each vane is provided. The translation axis is offset from the rotation axis such that when a fluid pressure on a leading and trailing surface of the vane is not equal, each vane is oriented substantially perpendicular to a direction of fluid flow. In some examples, the vanes reach a maximum extraction distance at the pumping zone.

The rotary device may further include first and second ports and a seal. The first port receives a fluid and the second port delivers the fluid. Additionally, the seal allows the fluid to flow into and out of the rotary device substantially only through the first and second ports.

Another aspect of the disclosure provides a rotary device for use with a fluid. The device has a device center and includes a housing, a rotor and a vane. The housing has a tubular surface that defines a first and a second zone. The device rotates in a direction from the first zone to the second zone. The rotor is mounted for rotation about a rotation axis about the device center. The rotor includes a body that is mounted within the tubular surface and has a plurality of slots where each slot extends radially from the axis. The vane is mounted within each slot. The rotary device rotates from the first zone to the second zone, and each vane extends and retracts within the tubular surface. The first and second zones form first and second arcuate shapes. The first arcuate shape differs from the second arcuate shape in at least one of a first center of the first arcuate shape different than the device center, and the first arcuate shape radius different than a radius of the rotary device.

In some examples, the rotor rotates in a first zone expanding the vanes gradually to reach a maximum extraction distance at the second zone. Each vane is connected to a respectively associated wiper. The wiper is separated from the tubular surface by a first distance in the first zone and in contact with the tubular surface at the second zone. Additionally, the tubular surface further defines a third zone adjacent to the second zone where the vanes retract into the slots in the third zone when the respectively associated wiper reaches the third zone. The respectively associated wiper is separated from the tubular surface by a third distance in the third zone.

The second arcuate shape may have a center concentric to the device center, and a radius of the rotary device different than a radius of the second arcuate shape. In some examples, the first arcuate shape and the second arcuate shape connect at a point substantially tangent to one another.

The rotary device may include a first port, a second port, a seal, and a chamber. The first port receives a fluid and the second port for delivers the fluid. The seal allows the fluid to flow into and out of the rotary device substantially only through the first and second ports. The chamber is defined between adjacent pairs of vanes, the rotor and the tubular surface. The chamber increase in volume when in communication with the first port and decrease in volume when in communication with the second port. The chamber being at maximum volume in the second zone.

Additionally, the rotary device may further include an oval track defined in the housing. A track follower may be connected to each vane, each vane traverses the track. The track follower controls a wiper distance from the tubular surface. The wiper distance being the distance between the wiper and the tubular surface. In some examples, the track is separated by a variable distance from the tubular surface. Additionally or alternatively, each vane may extend and retract when a first fluid pressure on a leading surface is substantially equal to a second fluid pressure on a trailing surface of the vane.

Another aspect of the disclosure provides a method of operation of a rotary device. The method includes pumping a fluid in the rotary device. The rotary device has a tubular surface that defines a pumping zone and a first working zone. The method also includes rotating a rotor. The rotor is mounted for rotation about a rotation axis and has a body mounted within a tubular surface. The rotor includes slots where each slot extends at least generally radially from the axis. In addition, each slot houses at least a portion of a vane having a wiper disposed on an end of the vane. The method also includes extracting, at a first extraction distance, the vane at the working zone of the tubular surface. The first extraction distance is a non-zero distance that separates the wiper from the tubular surface. The method also includes extracting, at a second extraction distance, the vane at the pumping zone of the tubular surface. The second extraction distance is the distance separating the wiper from the tubular surface and is substantially equal to zero. The method includes pumping the fluid out of the rotary device. The first extraction distance gradually increases until it reaches a minimum first extraction distance, the minimum first extraction distance being equal to the second extraction distance.

In some examples, during extracting, at the first extraction distance, the wiper is separated from the tubular surface by a variable distance. The variable distance decreases as the first extraction distance increases and the vane approaches the pumping zone. The method may further include retracting, at a first retraction distance, the vane at a second working zone adjacent the pumping zone. The first retraction distance is the distance that separates the wiper from the tubular surface. Additionally or alternatively, the method may further include sealing the fluid to flow into and out of the rotary device substantially only through an input port and an output port.

Yet another aspect of the disclosure provides a method of operating a rotary device. The method includes pumping a fluid in the rotary device. The rotary device has a tubular surface that defines defining a first and a second zone. The method also includes rotating a rotor mounted for rotation about a rotation axis. In addition, the method includes extracting a vane from the rotor at the first zone, and extracting the vane from the rotor at the second zone. The first and second zones form first and second arcuate shapes, the first arcuate shape being different than the second arcuate shape.

In some examples, the rotor has a body mounted within a tubular surface and has slots. Each slot extends at least generally radially from the axis and houses a vane. Each vane has a wiper disposed on an end of the vane. The wiper contacts the tubular surface of the second zone, the wiper is at a distance greater than zero from the tubular surface of the first zone. Additionally or alternatively, the method may include sealing the fluid to flow into and out of the rotary device substantially only through an input port and an output port.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

Figure 1:
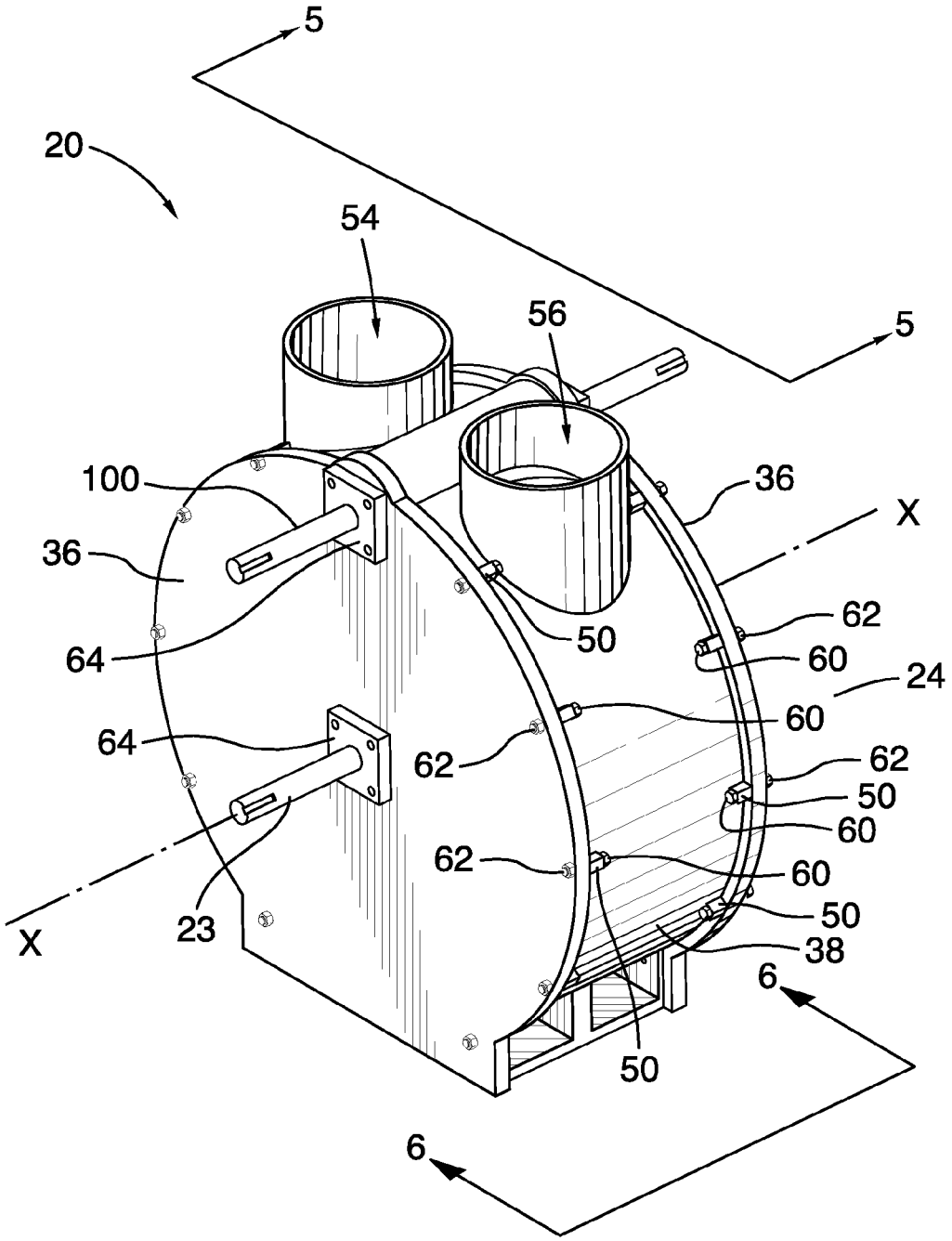
FIG. 1 is a perspective view of a pump according to an exemplary embodiment of the invention.

An exemplary embodiment of the invention is shown in FIGS. 1-18 and is embodied as a pump 20. The pump will be seen in FIG. 3 to comprise a housing 22, a primary shaft 23, a rotor body 24, a plurality of vanes $\mathbf{26}^1$, $\mathbf{26}^2$, $\mathbf{26}^3$, etc., a pair of discs 28, an arrangement 30, a sealing structure 32 and a coupler 34.

The housing 22 includes a pair of end plates 36 and a housing body 38.

Figure 2:
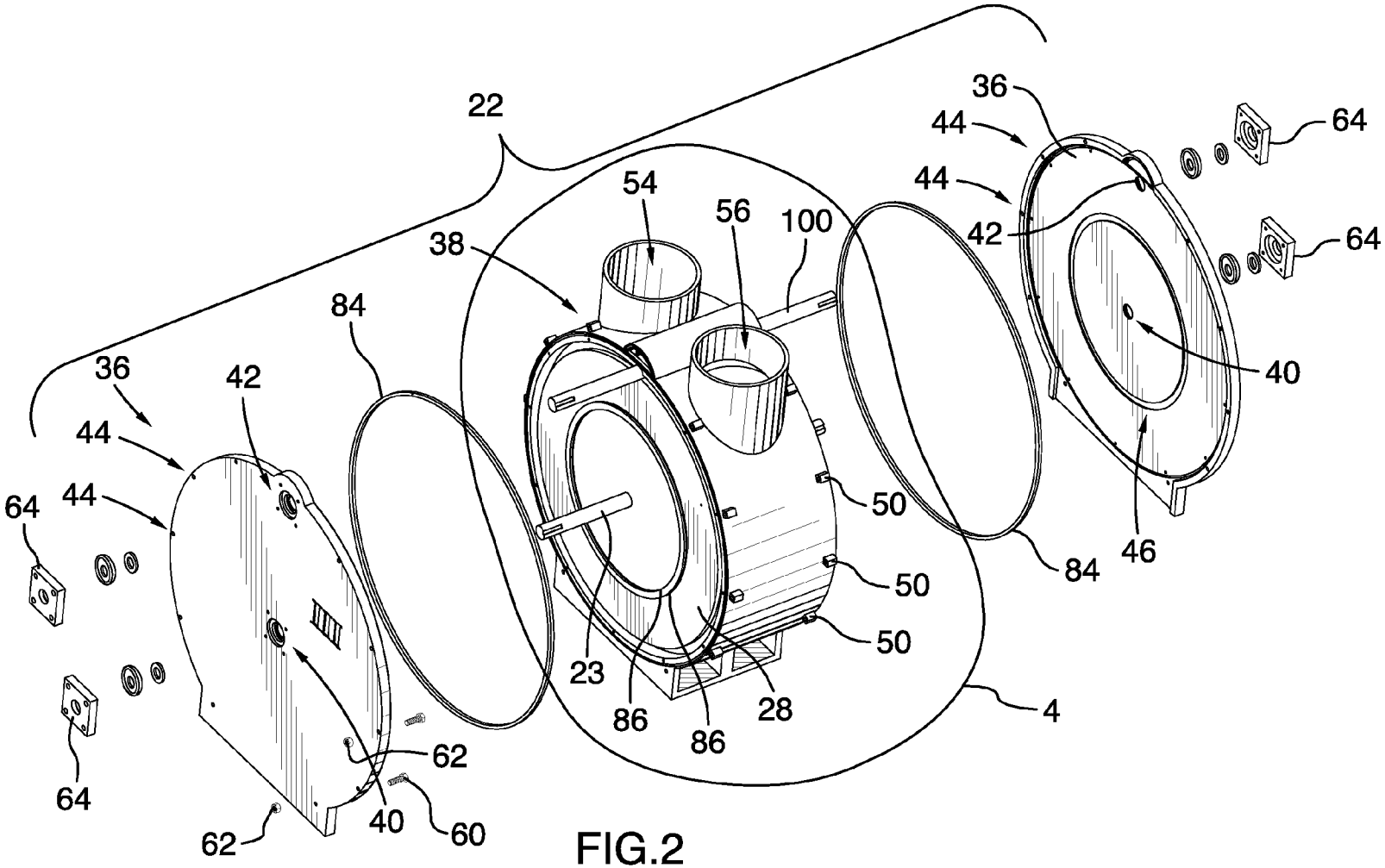
FIG. 2 is a partially exploded view of the structure of FIG. 1.

As best seen in FIG. 2, each end plate 36 has a central aperture 40, a peripheral aperture 42, a plurality of through holes 44 and, on the inner face thereof, an annular groove 46.

With reference to FIGS. 1-5B, the housing body 38: is captured between the end plates 36; defines interiorly a tubular surface 48; defines interiorly a through passing bore 49; has a plurality of lugs 50 disposed exteriorly thereof; and has defined there within, on each side, an annular channel 52. Tubular surface 48 will be seen to: be oval in cross-section; to have first 54 and second 56 ports defined therein; and to have a socket 58 defined there within, intermediate the ports 54, 56. The lugs 50 are provided one for each of the through holes 44 of the end plates 36 and are occupied, in use, by nut 60 and bolt 62 assemblies that secure the end plates 36 to the housing body 38. In this description and in the accompanying claims, "oval" shall be understood to have the ordinary meaning attributed thereto, namely, generally in the shape of an egg, and does not imply any specific geometric relationship.

The primary shaft 23, which is keyed at both ends and centrally, passes through the tubular surface 48 in spaced parallel relation and is mounted for rotation to the end plates 36 by bearings 64.

The rotor body 24, which is disposed interiorly of the tubular surface 48 and mounted to the primary shaft 23 for rotation therewith, has a plurality of slots $\mathbf{66}^1$ $\mathbf{66}^2$, $\mathbf{66}^3$, etc., each slot 66 extending generally radially from the rotational axis X-X of the shaft 23.

Figure 10:
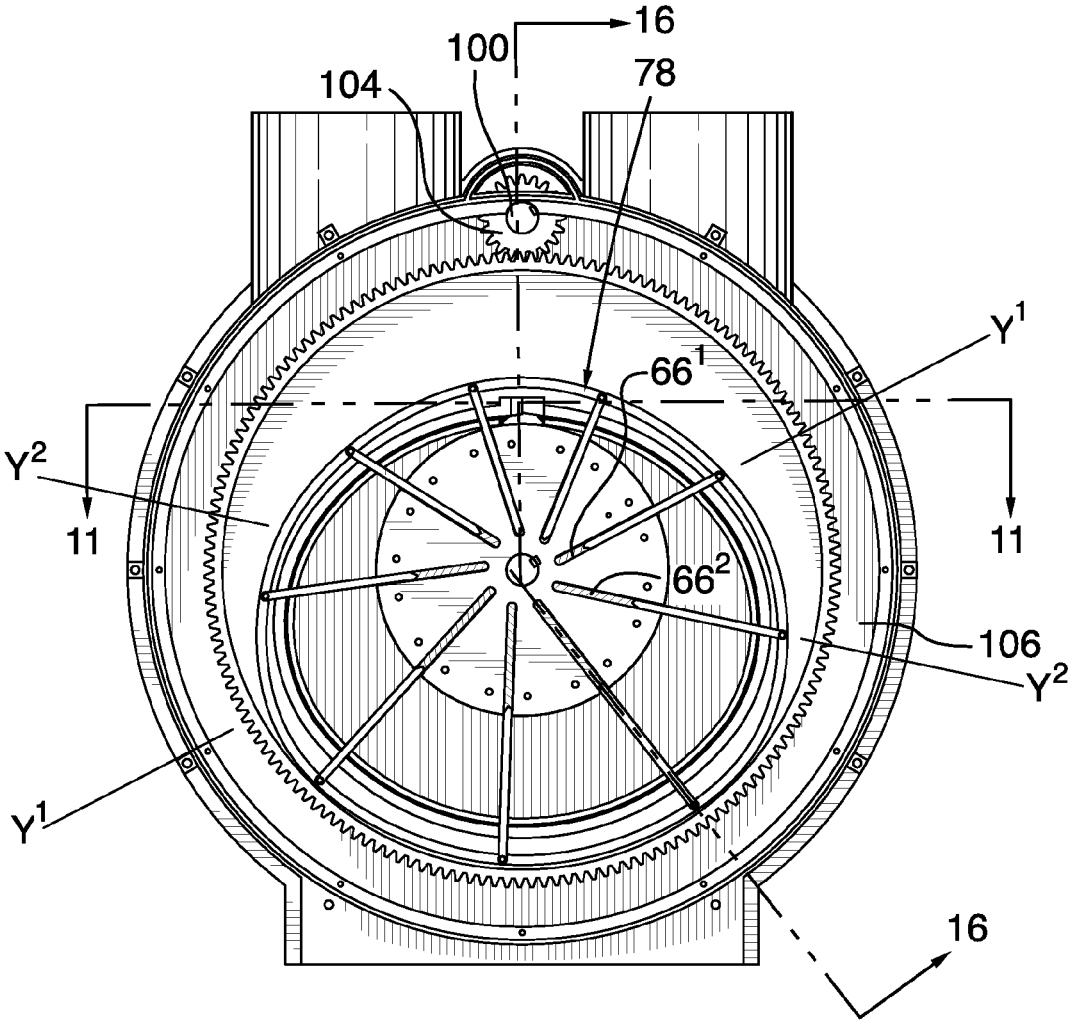
FIG. 10 is a front view of the structure of FIG. 7.
Figure 11:
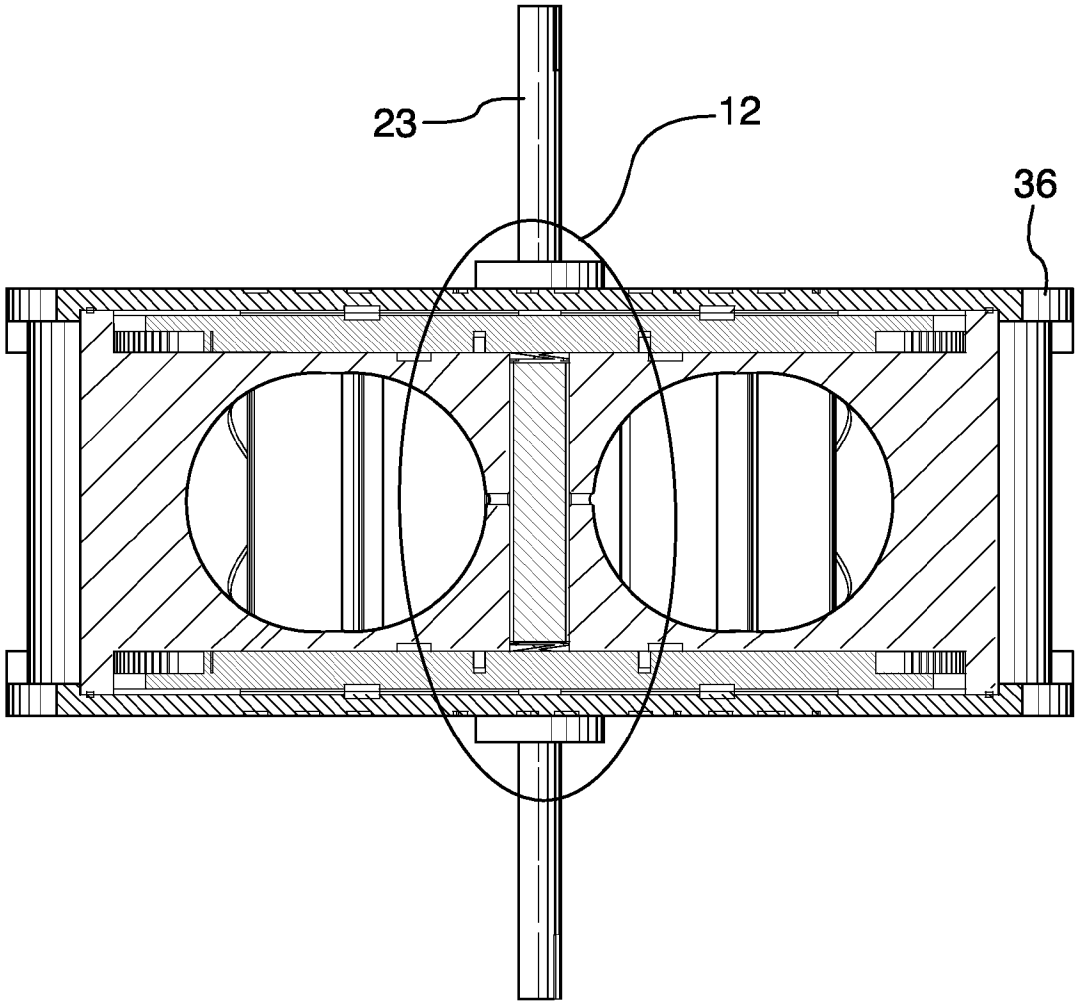
FIG. 11 is a view along 11-11 of FIG. 10.
Figure 12:
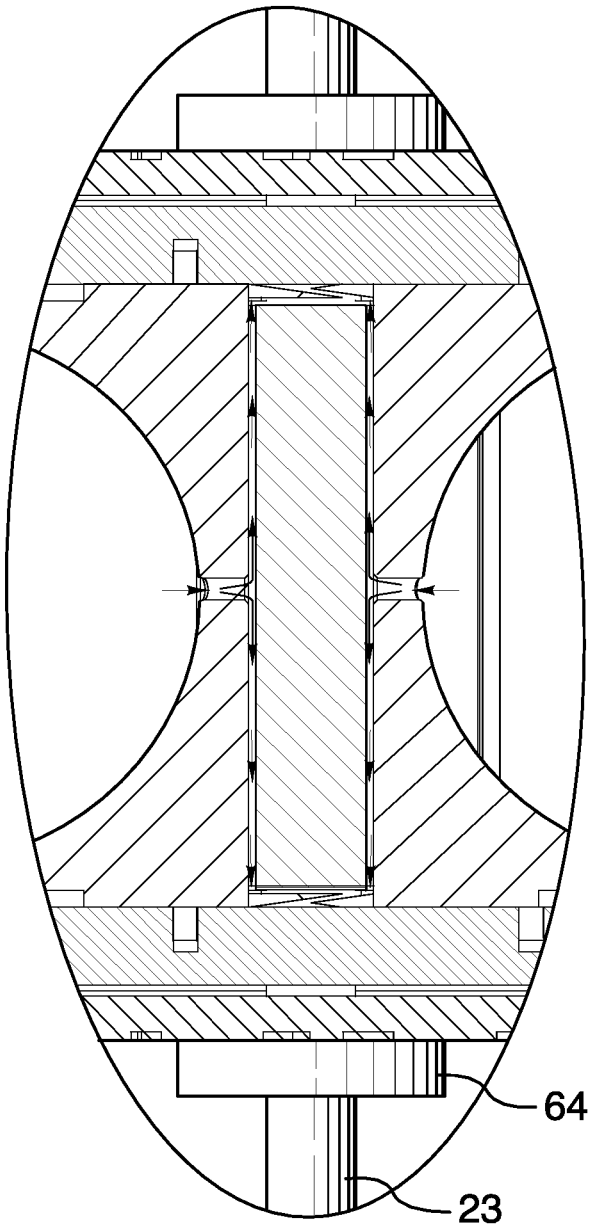
FIG. 12 is an enlarged view of encircled area 12 of FIG. 11.

The vanes 26 are provided one for each slot 66, each vane 26 being mounted in the slot 66 for which it is provided for reciprocation such that the tubular surface 48 can be swept by the vanes 26 as the rotor body 24 rotates. Each vane 26 extends and retracts along a translation axis $Y^1$-$Y^1$, $Y^2$-$Y^2$, etc. defined by the slot 66 for which said each vane 26 is provided, as indicated in FIG. 10

Returning to FIGS. 1 and 3, the discs 28 will be seen to be mounted on opposite sides of the rotor body 24 and have radial grooves 68 defined therewith aligned with the slots 66 of the rotor body 24 to support the vanes 26 when extended. Exteriorly of each disc 28 there is defined an annular groove 46.

The discs 28, in combination with the rotor body 24, define a rotor.

The arrangement 30 is for causing the vanes 26 to retract and extend as the rotor body 24 rotates, to sweep the tubular surface 48, and comprises an oval track 72 and, for each vane 26, a track follower 74 that traverses the track 72 and is rigidly connected to said each vane 26. The oval track 72 is defined by a pair of oval raceways 78 defined on opposite sides of the housing body 24.

Figure 4:
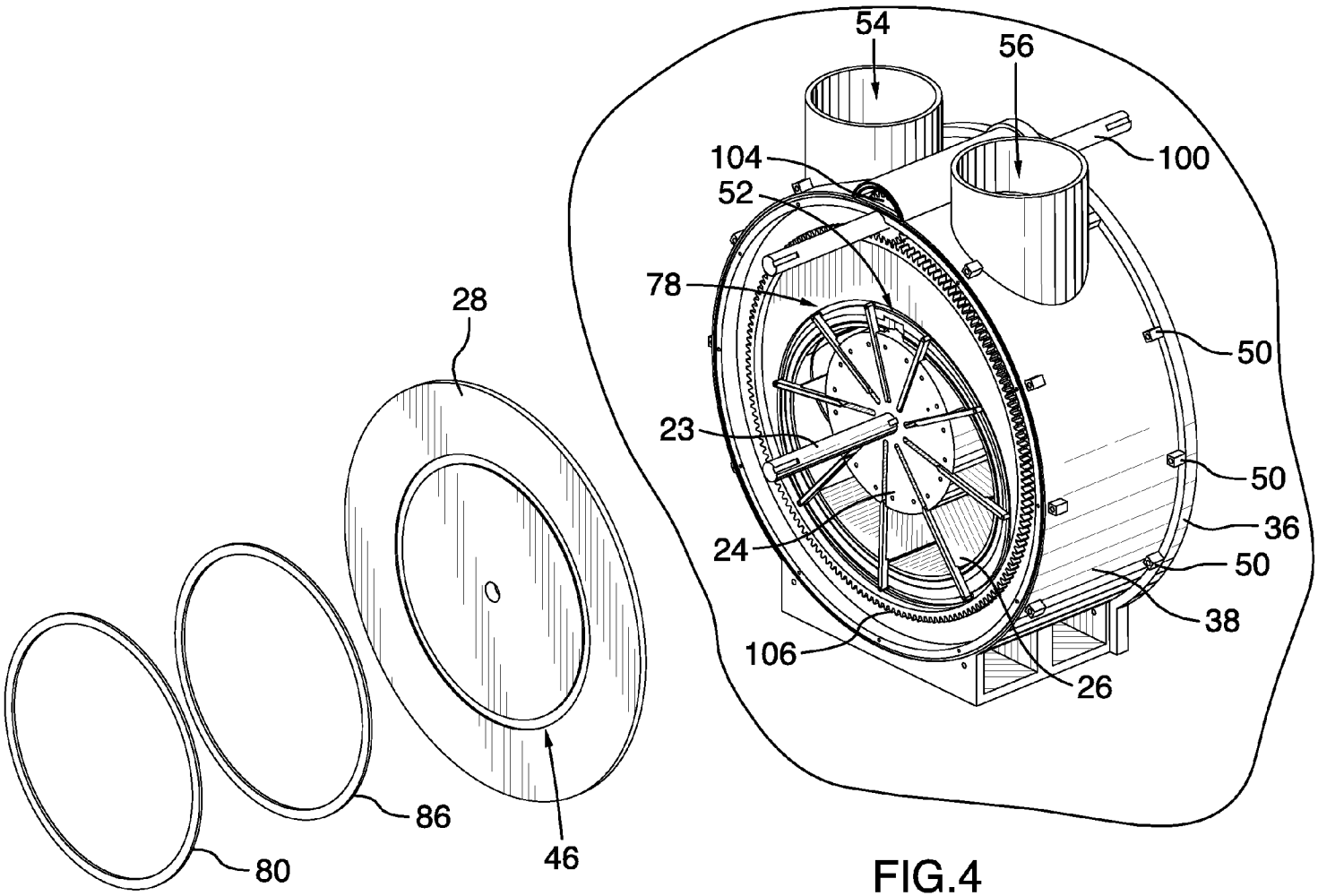
FIG. 4 is a partially exploded view of encircled area 4 of FIG. 2.
Figure 4A:
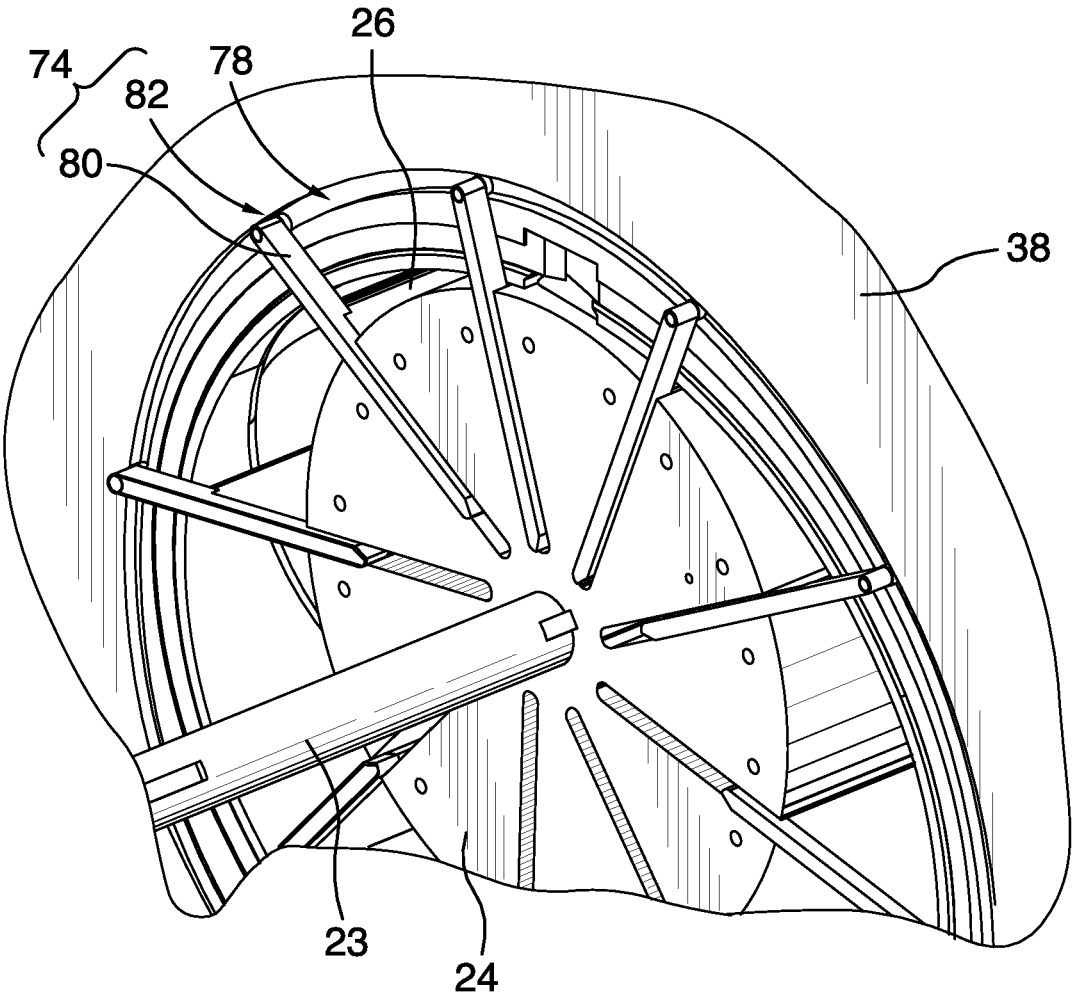
FIG. 4A is an enlarged view of a portion of FIG. 4.

The track follower 74 for each vane is defined by a roller assembly for each raceway 78, each roller assembly including an arm 80 rigidly extending from said each vane and a roller 82 rotatably mounted to the arm 80 to traverse said raceway 78, all as indicated in FIG. 4A The sealing structure 32 is for providing a seal to permit said fluid to flow into and out of the rotary device 20 substantially only via the first 54 and second 56 ports and adapted such that the vanes create chambers which increase in volume when in communication with the first port 54 and decrease in volume when in communication with the second port 56.

Figure 3:
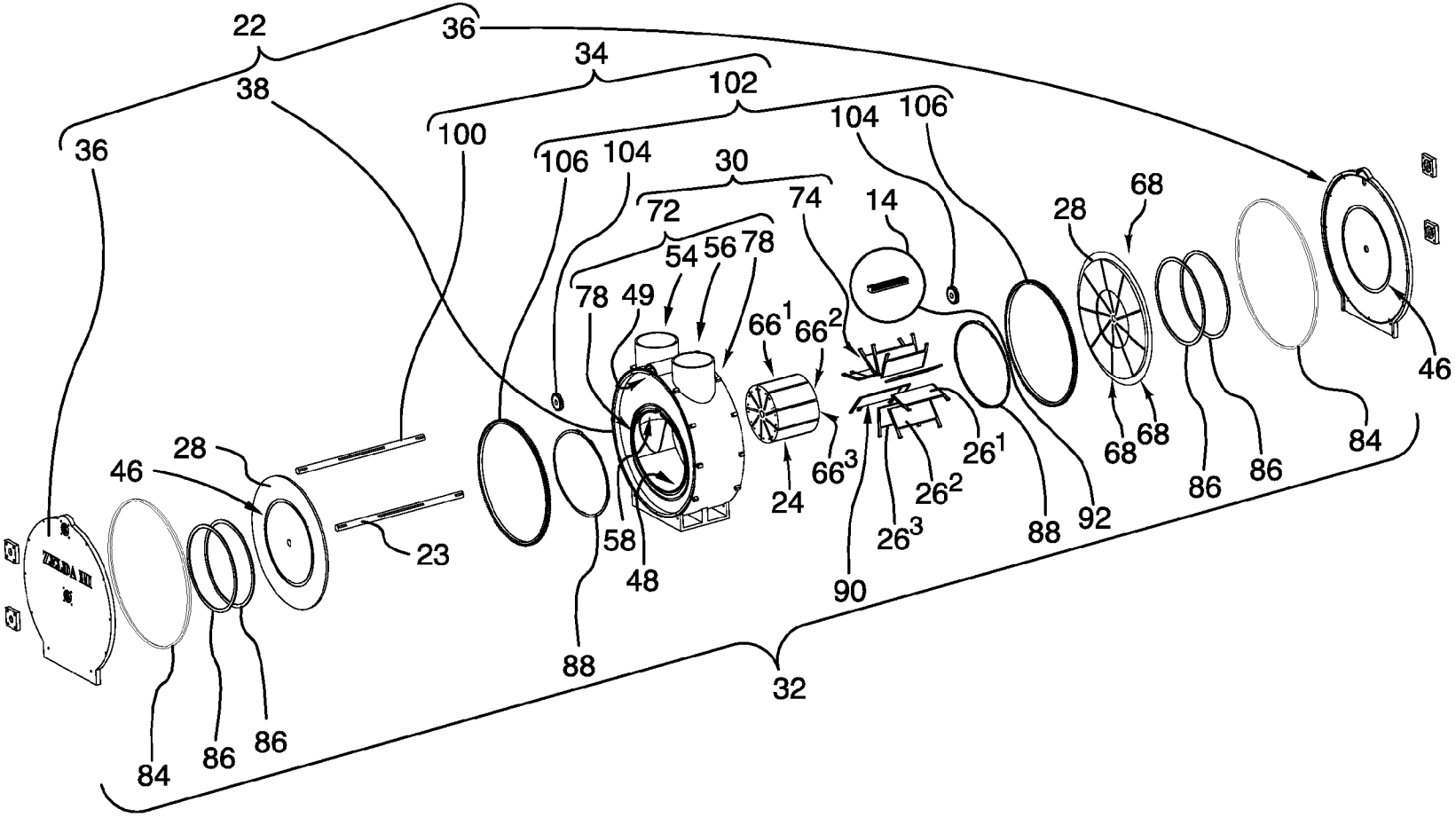
FIG. 3 is a fully exploded view of the structure of FIG. 1.

To provide this functionality, the sealing structure 32 comprises, as indicated in FIG. 3: outer gaskets 84, which seal the end plates 36 to the housing body 38; sealing rings 86 for each of the annular grooves 46, which provide for a dynamic seal between each disc 28 and the adjacent end plate 36; a rigid fitted gasket 88 disposed in each annular channel 52, which provides for a dynamic seal between the housing body 38 and the disc 28; wipers 90 (best seen in FIG. 9A) mounted to the tip of each vane 26; and a bridge seal 92 mounted in the socket 58.

Figure 14A:
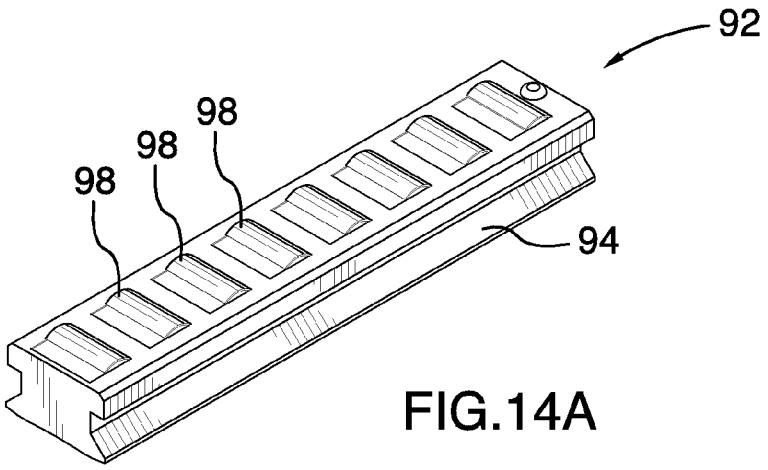
FIG. 14A is an enlarged view of encircled area 14 of FIG. 3.
Figure 14B:
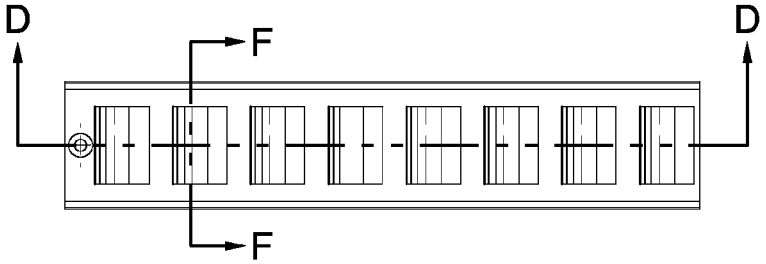
FIG. 14B is a top view of the structure of FIG. 14A.
Figure 14C:
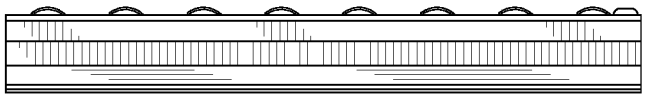
FIG. 14C is a side view of the structure of FIG. 14C.
Figure 14E:
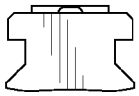
FIG. 14E is an end view of the structure of FIG. 14A.
Figure 14D:
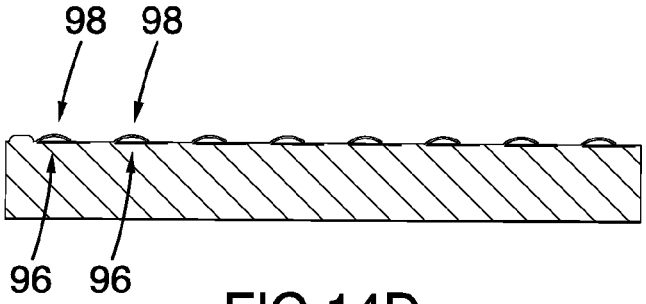
FIG. 14D is a section along D-D of FIG. 14B.
Figure 14F:
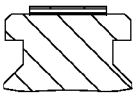
FIG. 14F is a section along F-F of FIG. 14B.
Figure 15B:
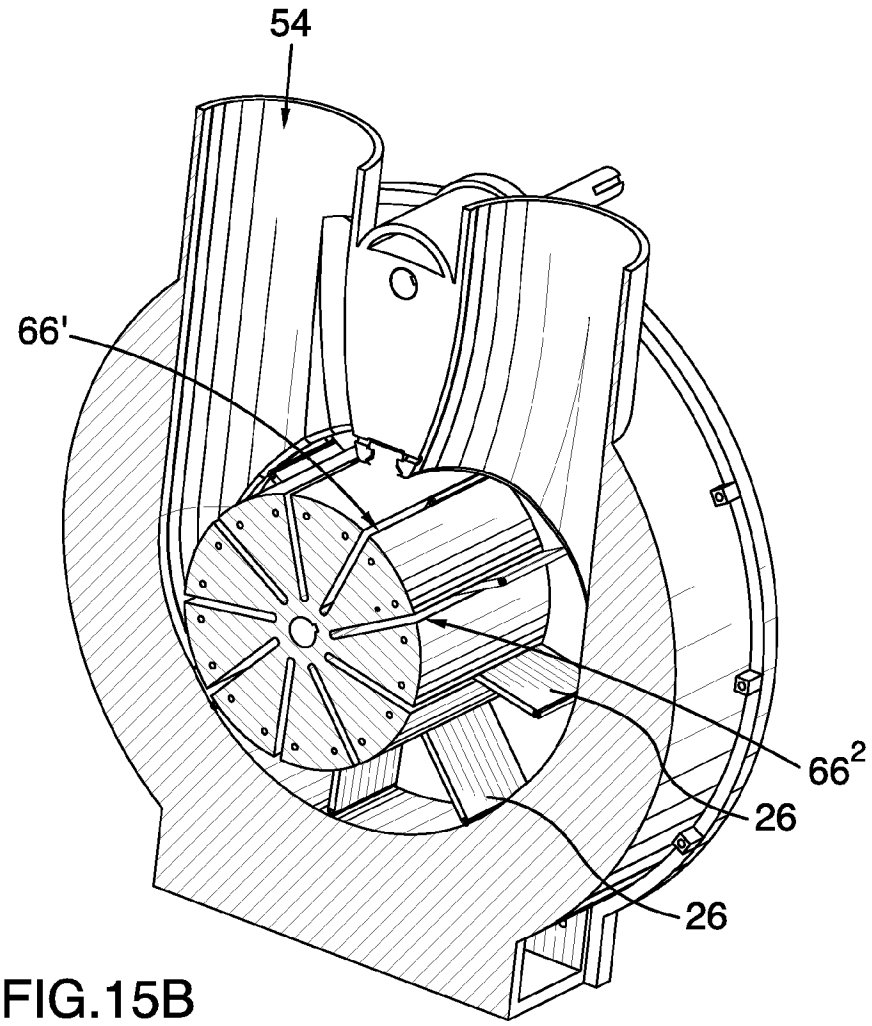
FIG. 15B is a view similar to FIG. 5A.
Figure 15A:
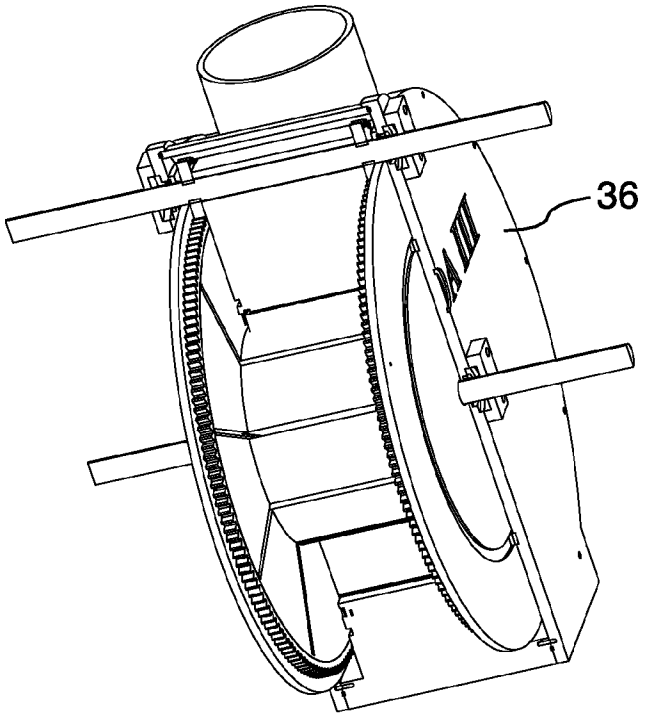
FIG. 15A is a partial cut-away of the structure of FIG. 1.
Figure 16:
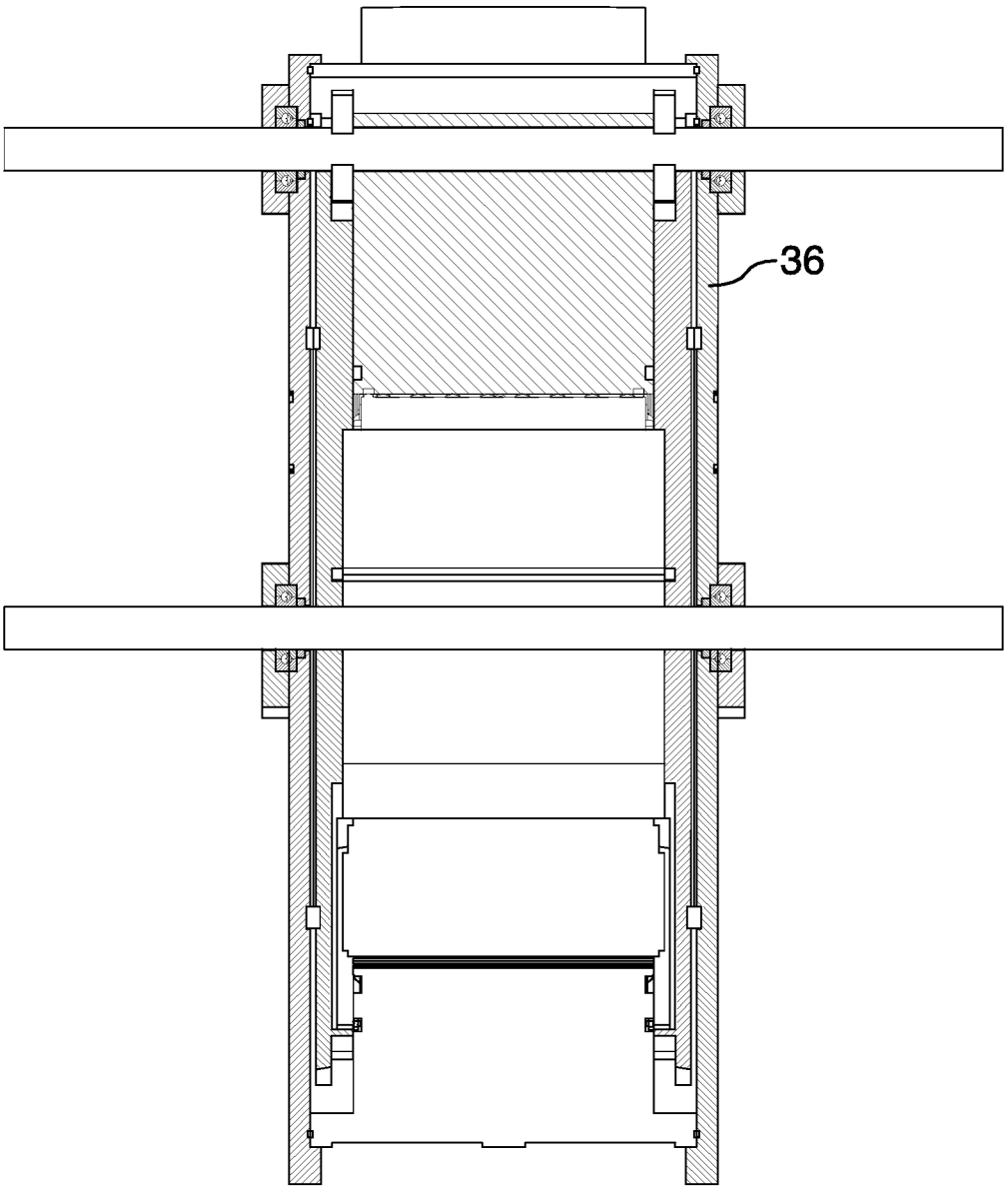
FIG. 16 is a view along 16-16 of FIG. 10.
Figure 17A:
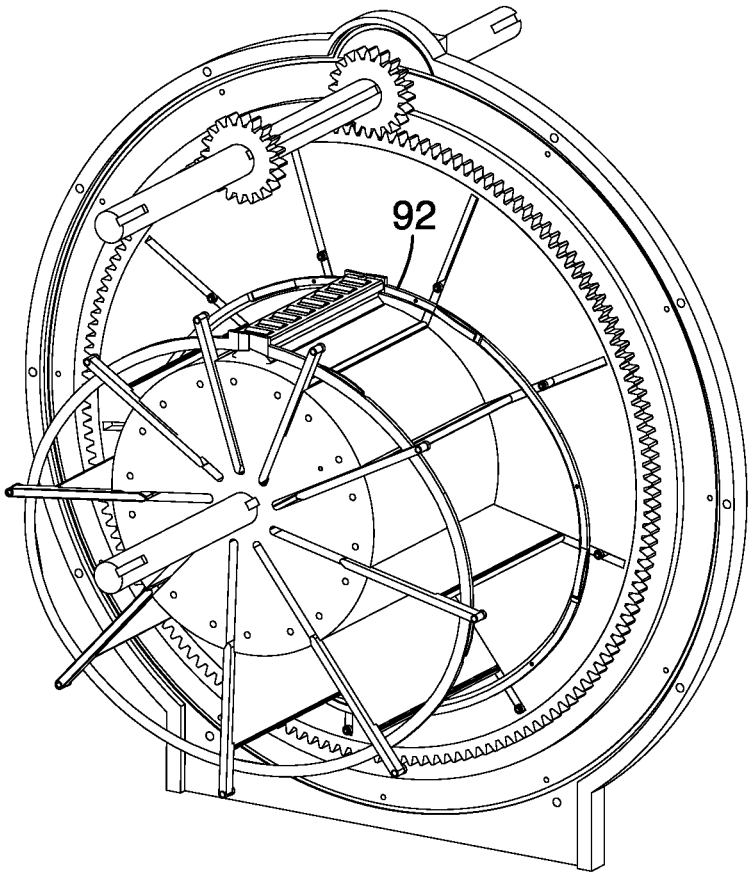
FIG. 17A is a view of the structure of FIG. 1, with portions removed for clarity.
Figure 17B:
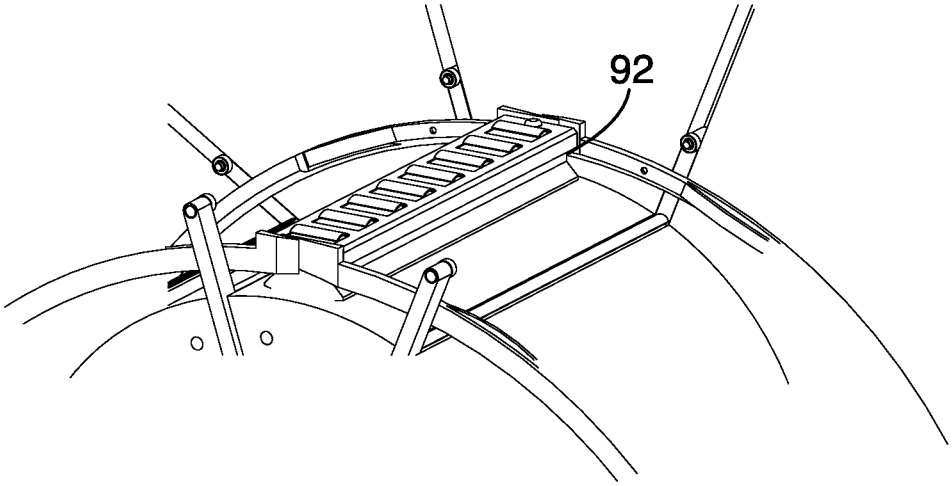
FIG. 17B is an enlarged view of a portion of FIG. 17A.

The bridge seal 92 is shown in isolation in FIG. 14A and will be seen to include: a wiper body 94; a plurality of recesses 96; and, in each recess 96, a spring 98, which collectively urge the wiper body 94 against the rotor body 24 for start-up. In steady-state operation, a bleed passage 110 which leads between the ports 54, 56 and the socket 58, allows working pressure to force the bridge seal 92 against the rotor body 24.

Returning again to FIG. 3, the coupler 34 will be seen to comprise a secondary shaft 100 and a gear arrangement 102. The secondary shaft 100, which is keyed at both ends and centrally, passes through the peripheral apertures 42 and the bore 49 and is mounted for rotation to the end plates 36 by bearings 64. The gear arrangement 102 operatively couples the secondary shaft 100 to the rotor 24, 36 and comprises a pair of first gears 104 keyed to the secondary shaft 100; and for each first gear 104, a second gear 106 carried by a disc 28 and in mesh with said each first gear 104. Persons of ordinary skill will readily appreciate that this provides an alternative mechanism for driving the pump: whereas the pump could be actuated by rotation of the primary shaft 23, this would necessitate, for example, a relatively low speed, high torque motor (not shown); the alternative provided by the secondary shaft 100 and gear arrangement 102 allows the pump to be actuated by rotation of the secondary shaft 100, using, for example, a relatively more commonplace high speed, low torque motor (not shown).

Figure 5A:
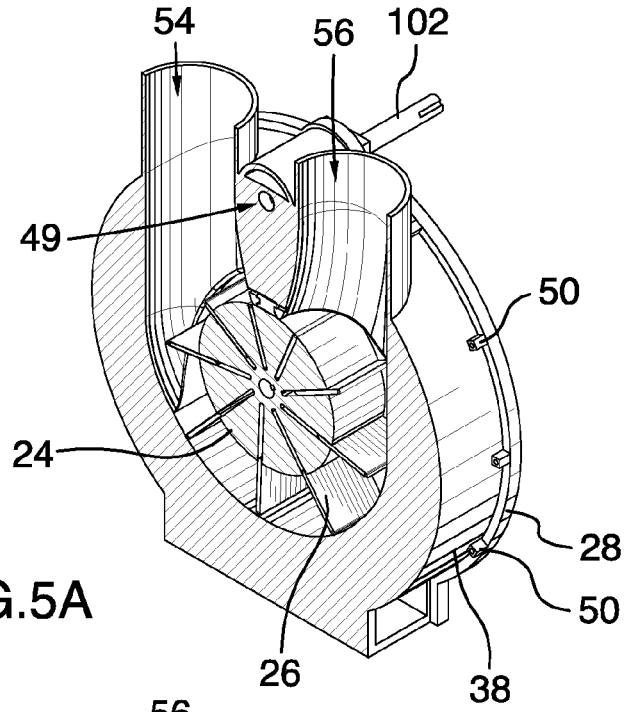
FIG. 5A is a perspective cross-sectional view along 5-5 of FIG. 1.
Figure 5B:
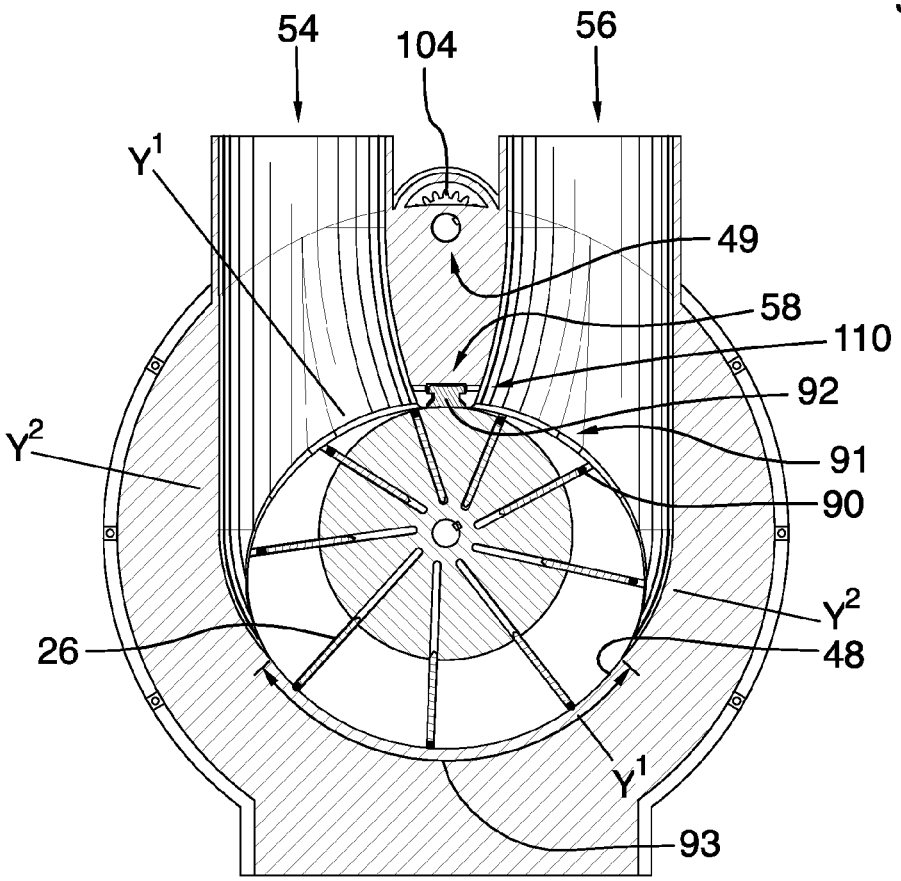
FIG. 5B is a front view of the structure of FIG. 5A.
Figure 6:
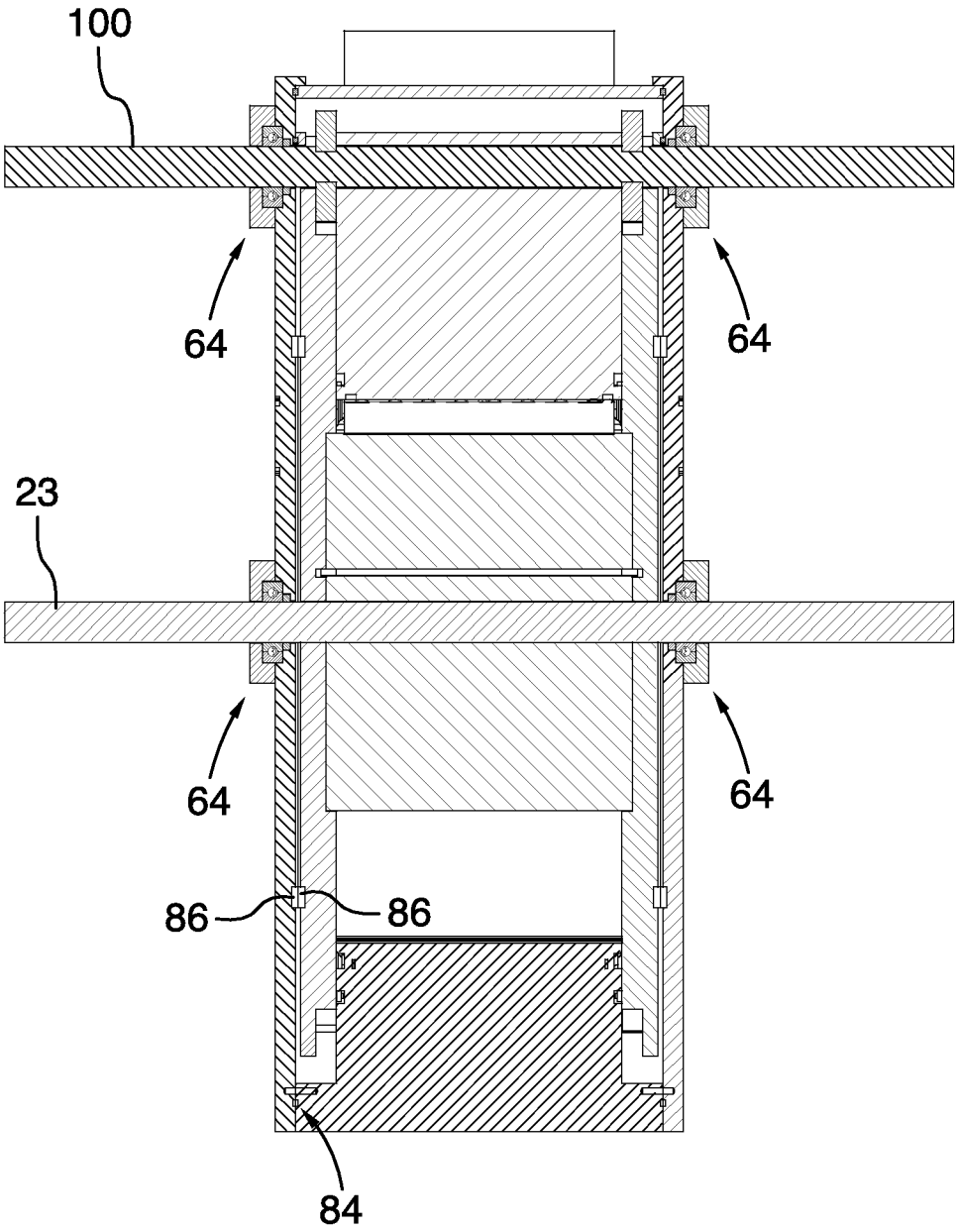
FIG. 6 is a cross-section along 6-6 of FIG. 1.
Figure 7:
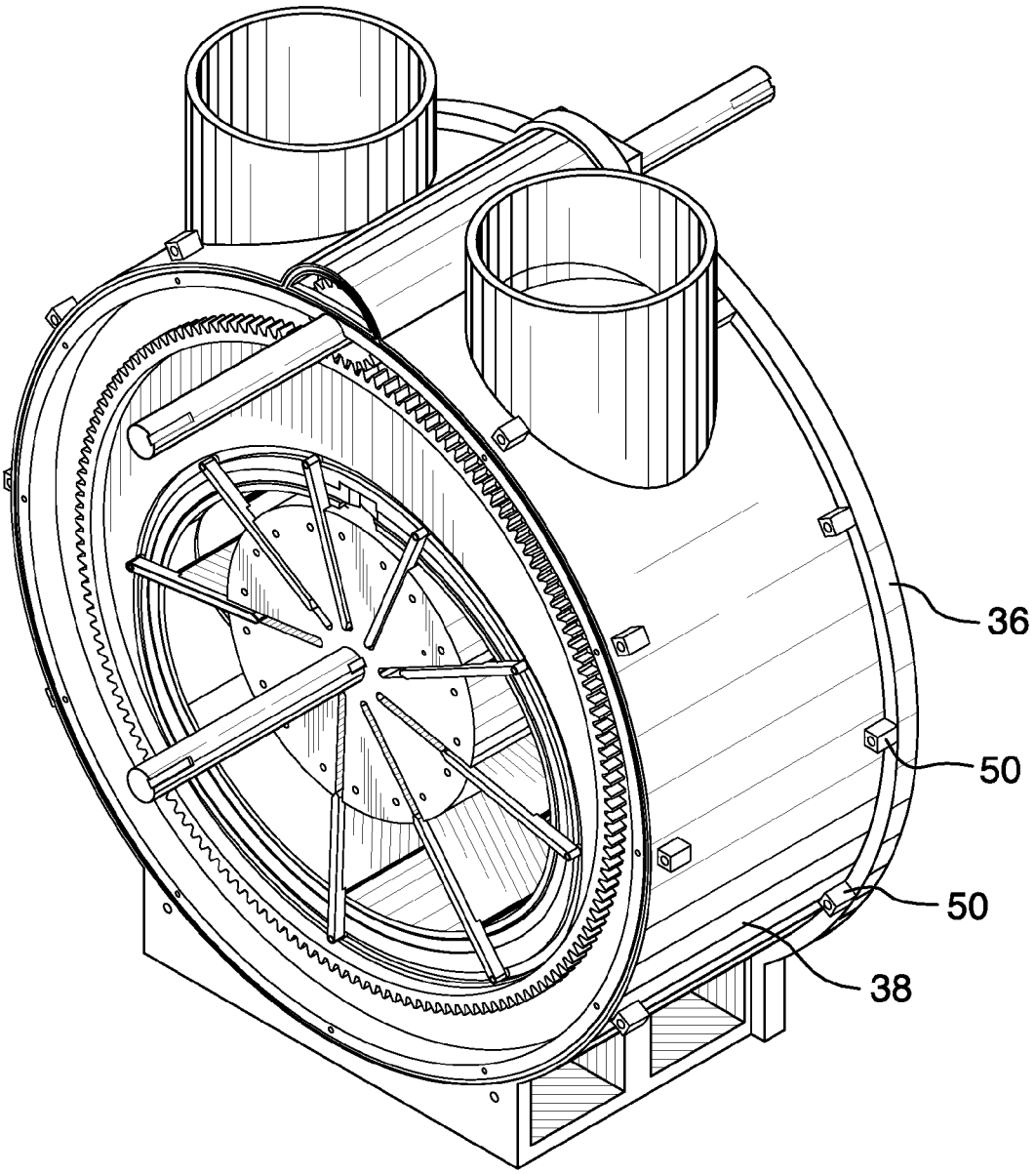
FIG. 7 is an enlarged view of encircled area 7 of FIG. 4.
Figure 8B:
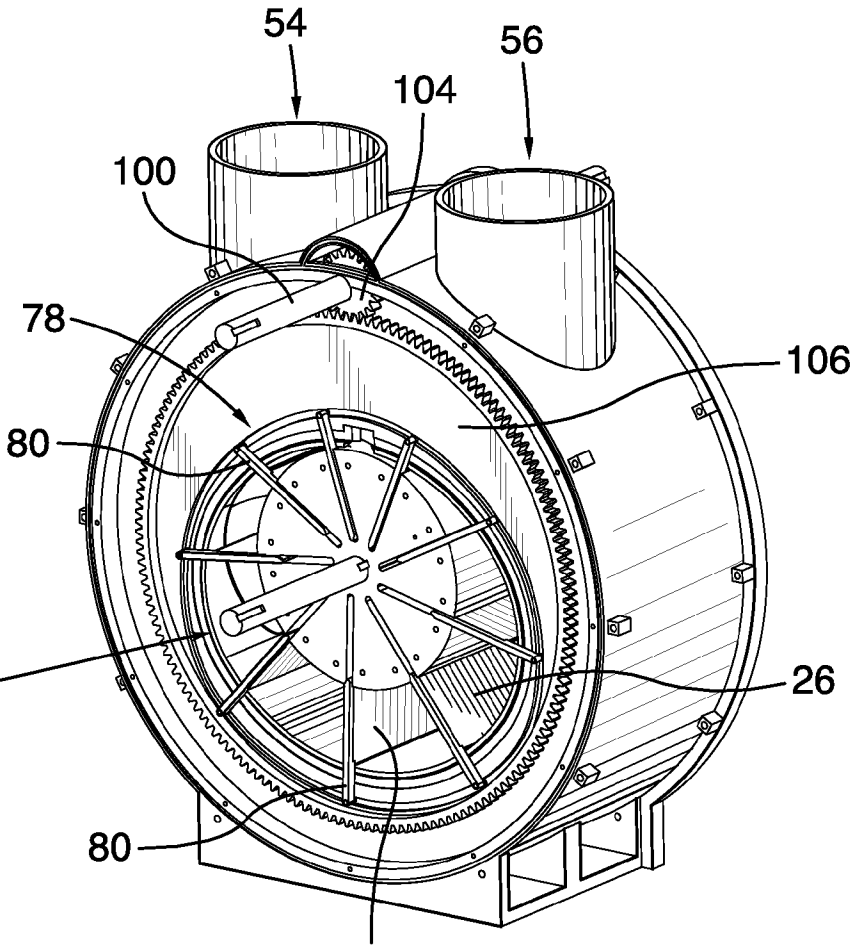
FIG. 8B is a view of the structure of FIG. 7, from another vantage.
Figure 8A:
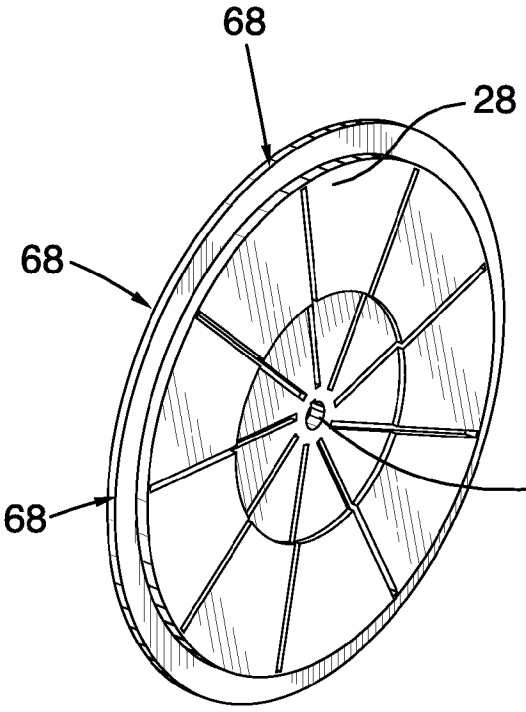
FIG. 8A is an enlarged view of encircled area 8 of FIG. 3.
Figure 9A:
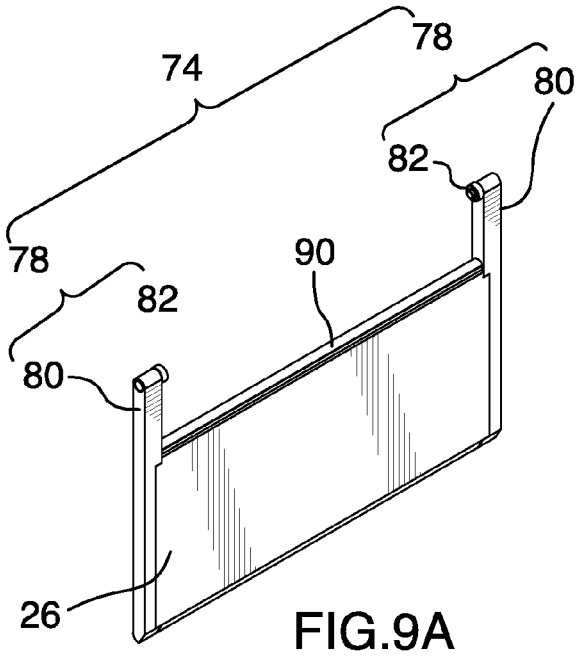
FIG. 9A is an enlarged view of the structure indicated by arrow 9A on FIG. 3.
Figure 9B:
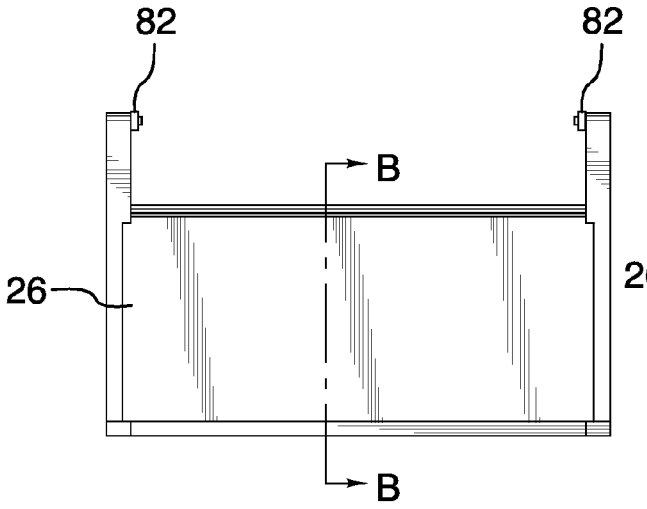
FIG. 9B is a front view of the structure of FIG. 9A.
Figure 9C:
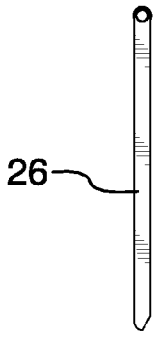
FIG. 9C is a side view of the structure of FIG. 9A.
Figure 9D:
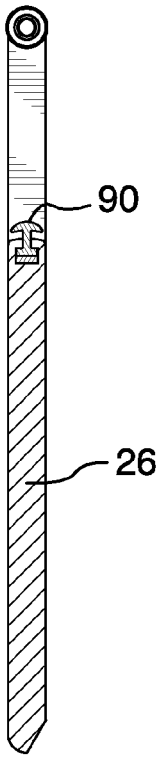
FIG. 9D is a view along B-B of FIG. 9B.
Figure 13:
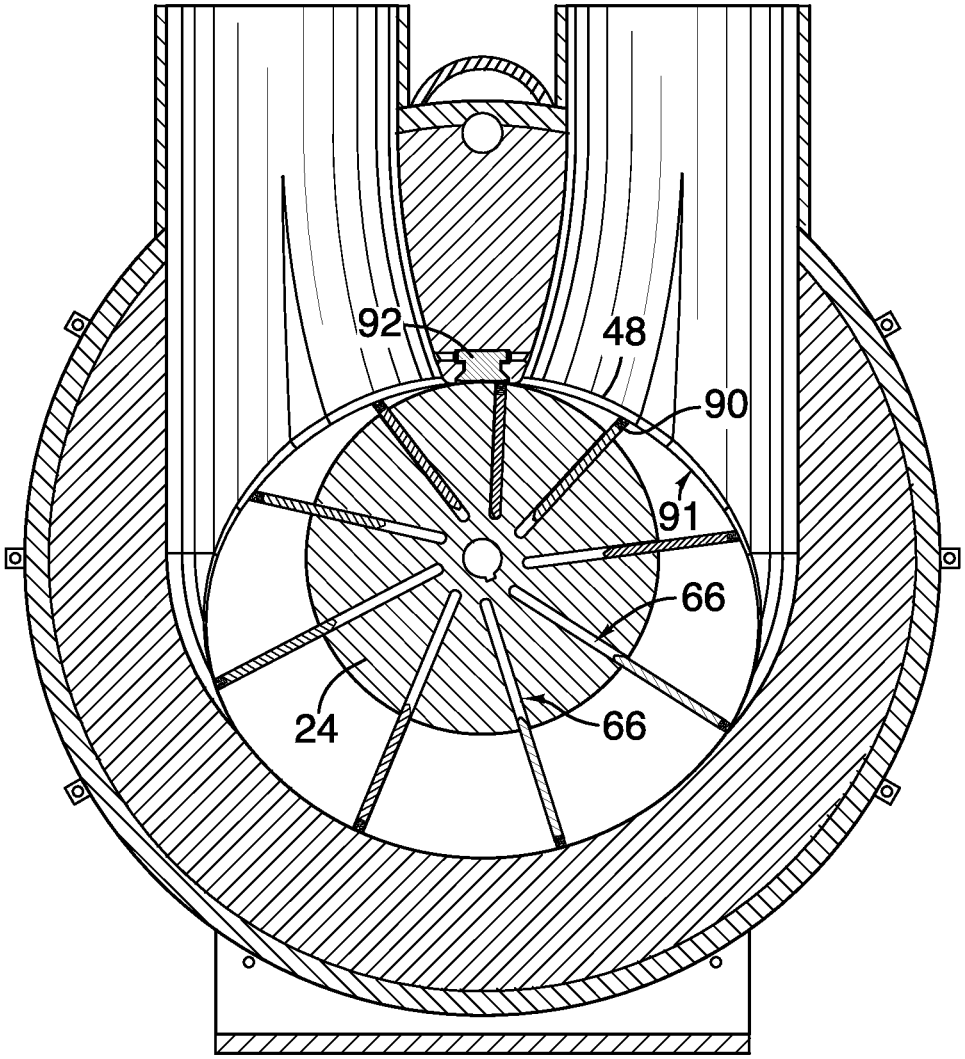
FIG. 13 is a view similar to FIG. 5B.

It will be evident that the above structure has significant advantage:

- by virtue of the shape of the oval track 72, which notably differs from the that of the tubular surface 48, in use:
  - generally-speaking, each vane 26 extends and retracts only when the fluid pressure on the leading and trailing surface of the vane is substantially equal; as a result, the loads borne by the track followers are relatively modest, wear occurs relatively slowly and mechanical efficiency is increased
  - the wipers 90 sweep the tubular surface 48 largely only in the pumping area [indicated by reference numeral 93 in FIG. 5B] and are otherwise spaced apart therefrom; as a result, wear occurs relatively slowly and mechanical efficiency is increased; as well, the retraction of the vanes well in advance of the bridge seal 92, and extension of the vanes well following the bridge seal 92 is, without intending to be bound by theory, believed to have advantage in the context of flow efficiency [less flow disruption]
  - a gap between each wiper 90 and the tubular surface 48 opens relatively quickly after the wiper 90 passes the pumping area 93, disappears relatively shortly before the wiper 90 reaches the pumping area 93, and grows relatively large outside the pumping area, with commensurate impacts on flow dynamics and efficiency. This is best seen in FIGS. 5B and 13, wherein it will be seen that the wipers 90 are spaced from the tubular surface 48 near the bridge seal 92, leaving a gap 91
  - the volume of the pumping chambers (the spaces defined between the rotor and the tubular surface, between adjacent pairs of vanes disposed in the pumping area 93) does not change, which allows for tight sealage and also facilitates sharing of loads amongst vanes
  - sudden drastic changes in vane position and vane motion are avoided, with advantageous impacts on wear
- by virtue of the orientation of the translation axes $Y^1$-$Y^1$, $Y^2$-$Y^2$, etc. of the vanes, i.e. offset from the rotation axis X-X, in use, when the fluid pressure on the leading and trailing surface of the vane is otherwise than substantially equal (i.e. when the vane is extended and under load), said each vane is orientated substantially perpendicular to the direction of fluid flow. This distributes the load from the vanes to the side disks and rotor body, thereby reducing loads in the vanes, simplifying production and avoiding turbulence in use
- the rigid fitted gasket 88 stops leakage and also allows the housing to have a relief or cut for removing or loading vanes for assembly or repairs.

Figure 18A:
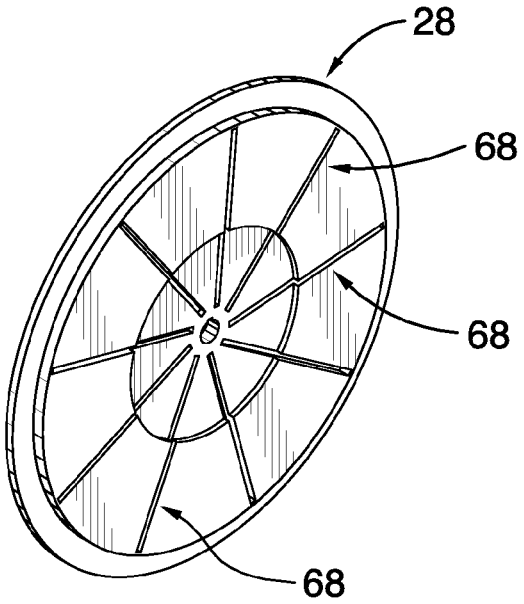
FIG. 18A is a view similar to FIG. 8A.
Figure 18B:
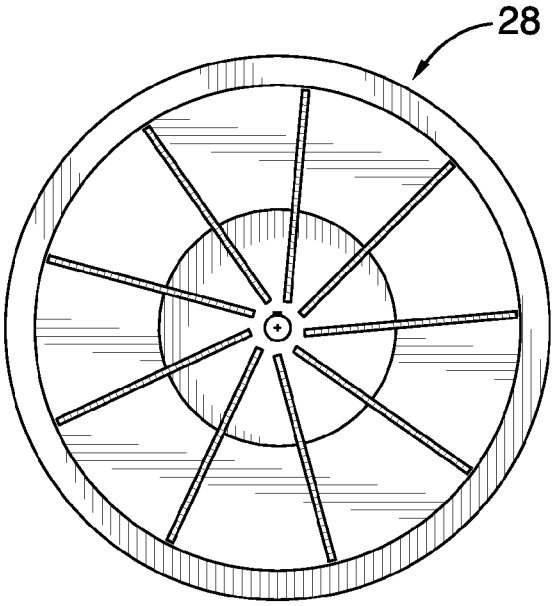
FIG. 18B is a front view of the structure of FIG. 18A.
Figure 18C:
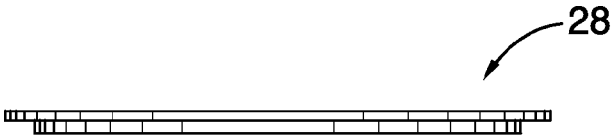
FIG. 18C is a side view of the structure of FIG. 18A.
Figure 19:
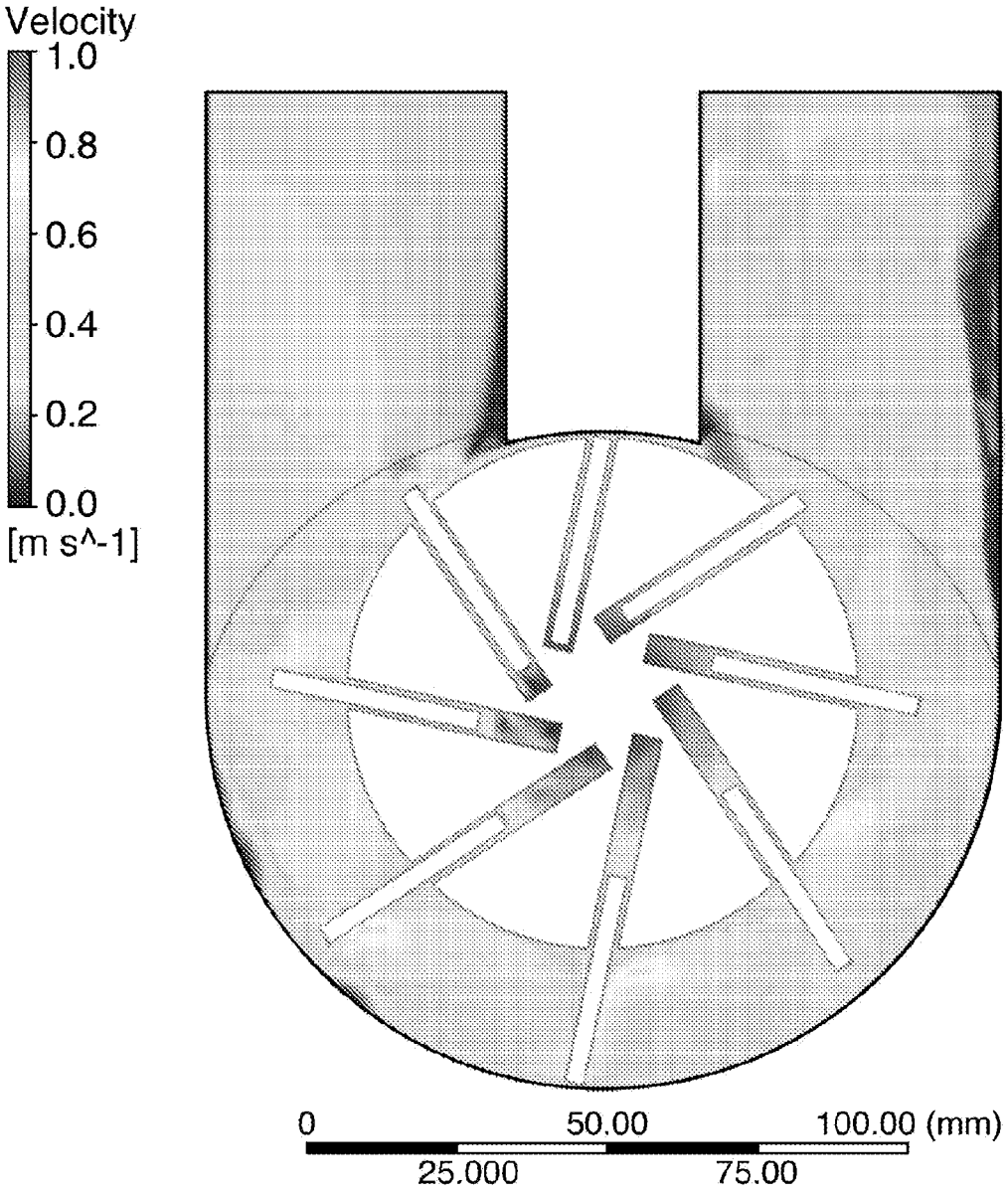
FIG. 19 is a fluid velocity plot.
Figure 20:
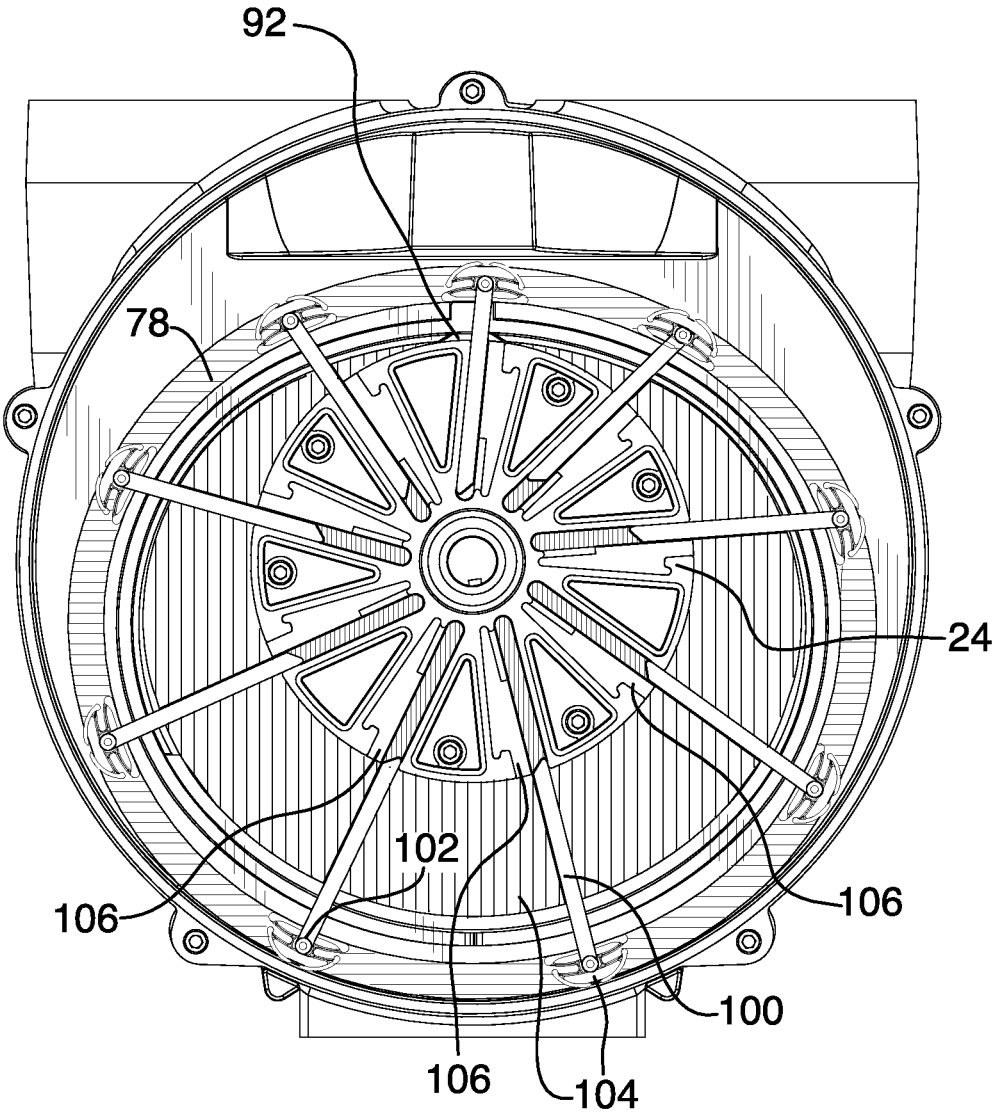
FIG. 20 is a view similar to FIG. 10 of another embodiment of the invention.
Figure 21:
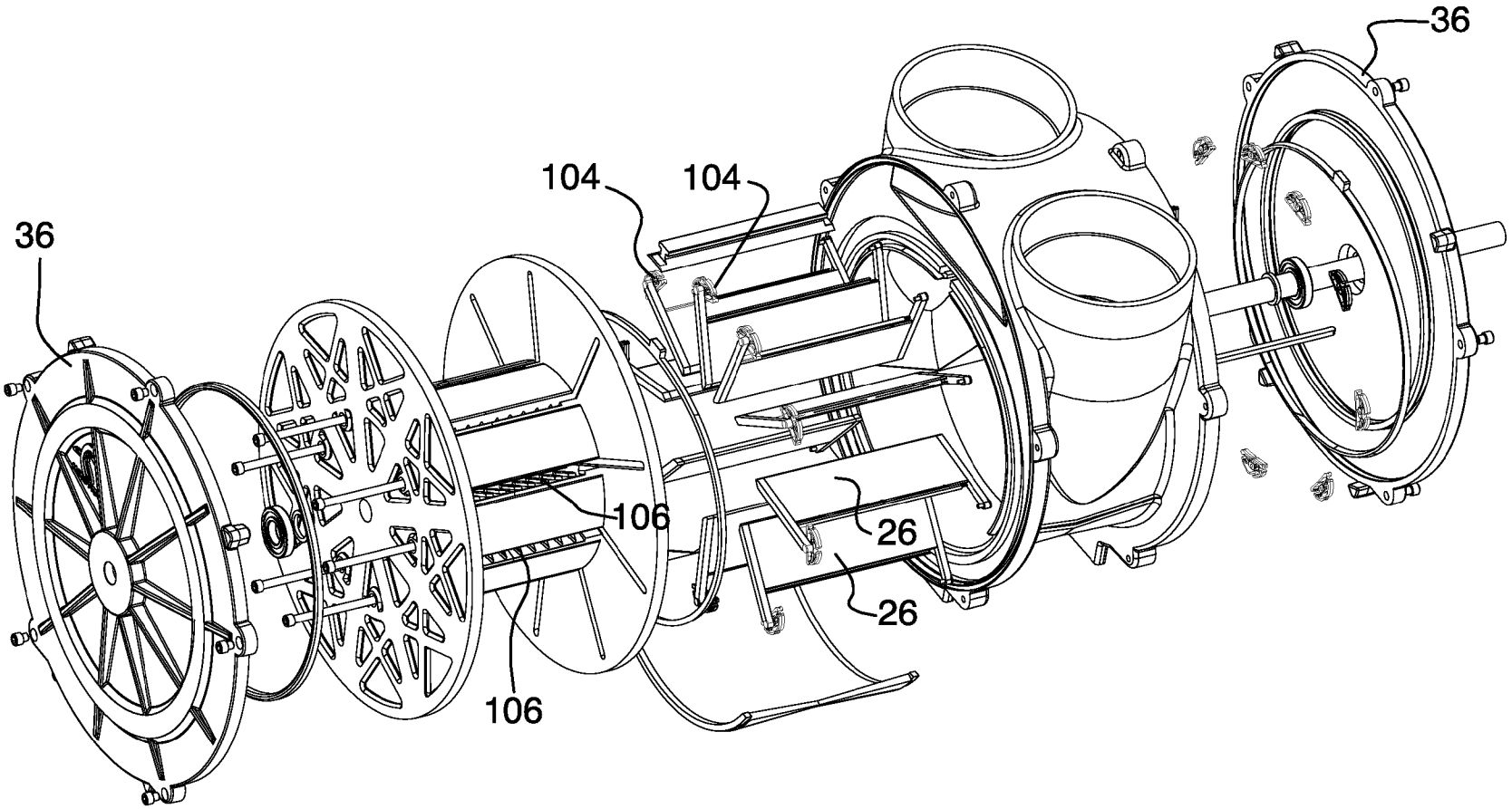
FIG. 21 is an exploded view of the embodiment of FIG. 20.

FIG. 19 is a CFD model based on a device similar in operation to the device of FIGS. 1-18C. [One notable difference being the existence of only eight (8) vanes, which was done for computational simplicity and is not believed to have any material effect on the result. For the purpose of the model, the vane geometry was simplified, and leakage flow at the vane tip was assumed; these divergences would undoubtedly impact the CFD results, but it is believed that these changes would not significantly impact upon the results.] Herein, it will be seen that the flow uniformity throughout the pumping region and at the inlet and outfall is reasonably good, and that velocity drops off significantly in the region near the bridge, that is, point of maximum vane retraction; persons of ordinary skill will appreciate that the foregoing suggests that turbulence is not a major concern, which has advantageous impacts upon efficiency.

In this regard, testing was done on a pump of the above-noted type, sized for movement of 1.3 gallons of water per rotation. The pump has shown the following characteristics:

- capable of self-priming water to 26'-6" at 100 rpm, at 1000 feet above sea level
- pumped 1.6 million gallons of water without failure
- when running at 0.644 HP, pumping 151.29 gpm of water, the pump achieved volumetric efficiency of 94.59% and mechanical efficiency of 83.33%

Whereas but a single embodiment is hereinbefore described, it will be evident that variations are possible.

For example, whereas a secondary shaft and coupler are illustrated in the structure of FIGS. 1-18C, these could be routinely omitted.

Further, whereas the device in FIGS. 1-18C is indicated to be a pump, it will be evident that the structure could be utilized with other rotary devices, such as motors, meters and propulsion devices.

Additionally, whereas specific designs are illustrated for the bridge seal, wipers, etc., it will be evident that sealing could be obtained through other mechanisms.

As well, whereas rollers are shown in FIGS. 1-18C, the followers could take other forms, for example, simple studs adapted for sliding movement in the track.

Indeed, another form of the followers is shown in FIGS. 20-23C.

These drawings show a rotary device similar to that shown in FIGS. 1-18C but differing notably therefrom in that:

- the track follower for each vane is defined by a bearing assembly for each raceway 78, each bearing assembly including (i) an arm 100 extending from said each vane and terminating in a pintle 102 and (ii) a bearing shoe 104 mounted to traverse said raceway 78 and in which the pintle 102 is mounted for rotation; and
- vent plates 106 are provided for each vane.

Figure 22A:
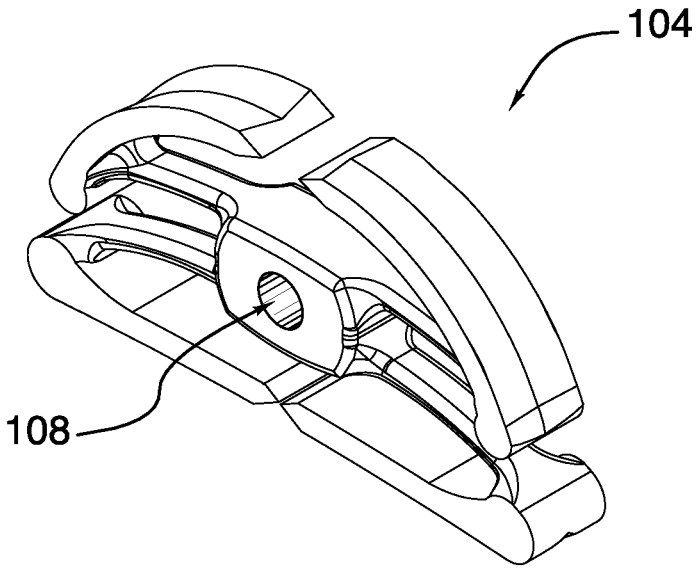
FIG. 22A is a perspective view of a portion of the structure of FIG. 20.
Figure 22B:
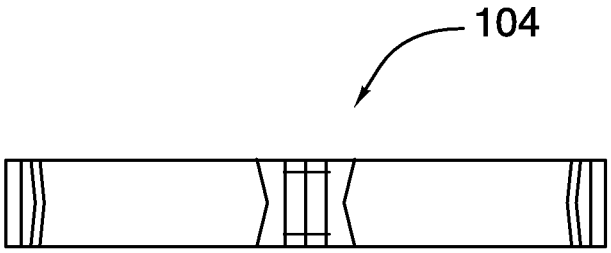
FIG. 22B is a top view of the structure of FIG. 22A.
Figure 22C:
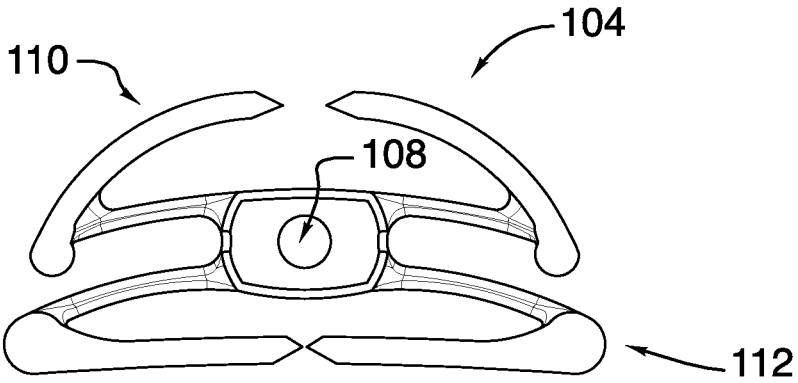
FIG. 22C is a front view of the structure of FIG. 22A.

The bearing shoe 104 will be seen in FIGS. 22A-22C to be an injection-molded, resilient, hard-wearing plastic device having a central socket 108 in which pintle 102 is mounted in use and having upper 110 and lower 112 runners.

The upper 110 and lower 112 runners are each formed generally in the manner of a leaf spring to allow for limited radial motion of the vane and allow the raceway 78 to be shaped so as to bring the wipers 90 against the tubular surface 48 with some force in the pumping area, i.e. the raceways and bearing shoes are shaped and adapted such that, but for the spring action of the bearing shoes, the wipers would be in interference contact with the tubular surface. The spring action ensures good sealage and also allows for thermal expansion and contraction of the vanes in use, which, if not otherwise accommodated, could result in wear or leakage depending upon the ambient conditions and the coefficient of thermal expansion of the vanes.

Figure 23A:
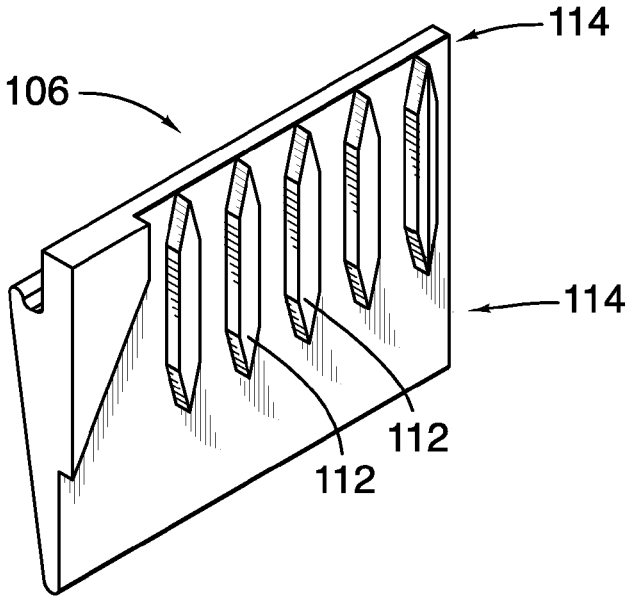
FIG. 23A is a perspective view of another portion of the structure of FIG. 20.
Figure 23B:
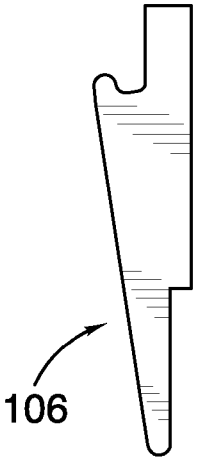
FIG. 23B is an end view of the structure of FIG. 23A.
Figure 23C:
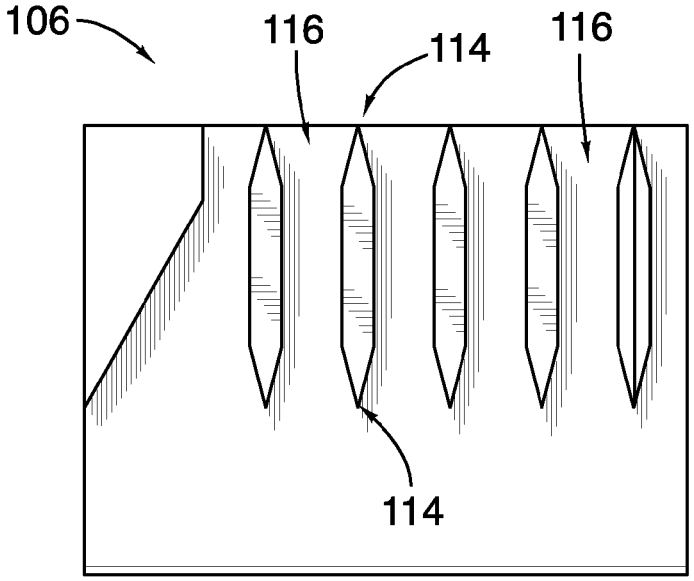
FIG. 23C is a front view of the structure of FIG. 23A.

The vent plates 106 are mounted one for each vane and so as to define one of the surfaces of the slot for each vane and against which said vane slides in use. The surface against which said each vane slides is defined by a plurality of raised ridges 112, each having tapered ends 114, so as to define channels 116 in which fluid can travel, as best seen in FIG. 23 C The vent plates 106 avoid hydraulic lock on vane extension and retraction which could otherwise occur in some situations. Vent plates 106 will be seen in FIG. 20 to each terminate at its radial limit in an arcuate extension of the rotor body, so as to provide for a smooth transition as the vent plates pass the bridge seal 92.

Figure 24:
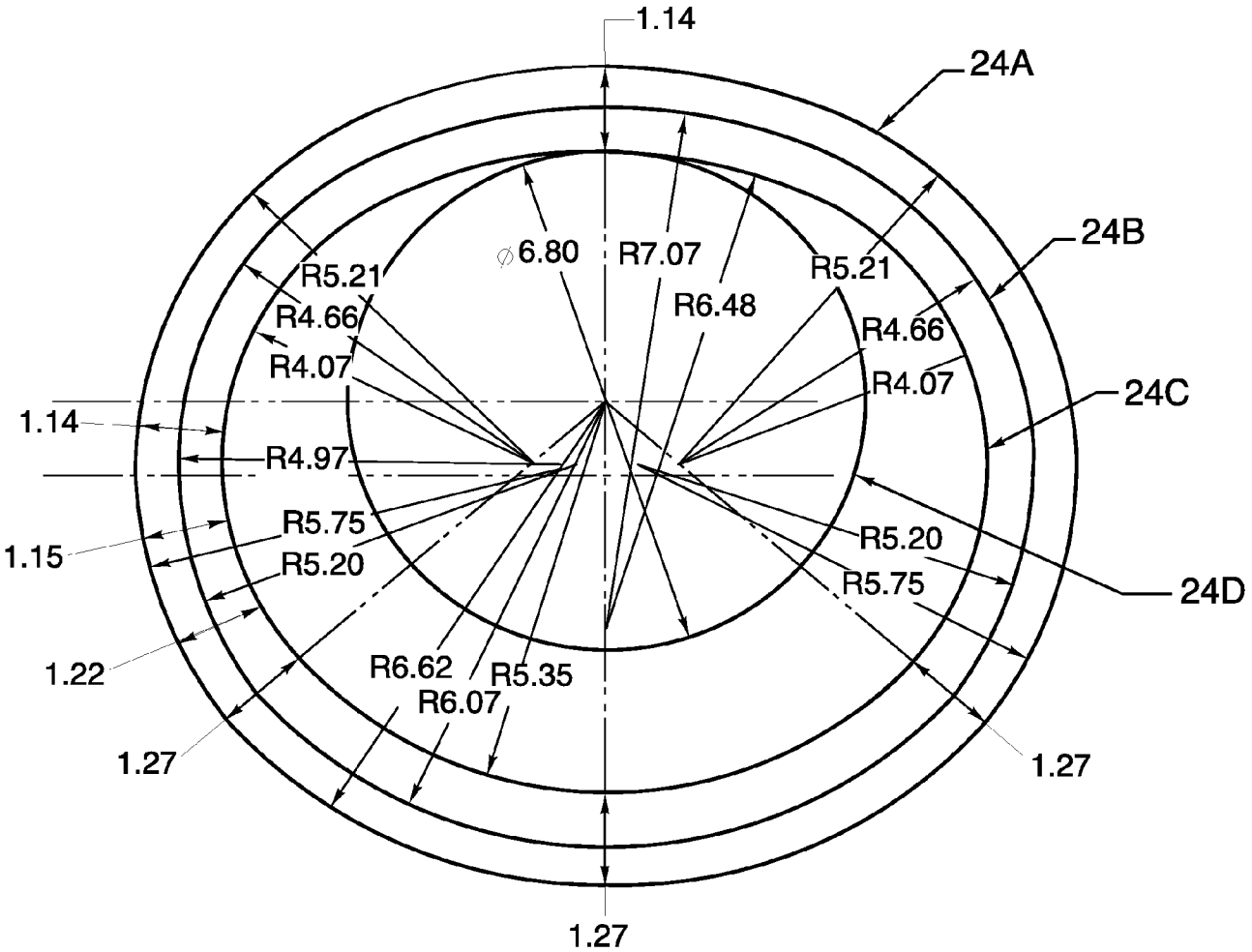
FIG. 24 is a diagram showing geometric relationships amongst the components of a rotary device according to an exemplary embodiment.

Additionally, whereas a specific geometry is shown in FIGS. 5B and 13, variation is also possible herein. In this regard, reference is made to FIG. 24, which shows the geometry of a rotary device according to an exemplary embodiment of the invention. In FIG. 24, the outside edge of the path of the bearing shoes is indicated by arc 24A; the inside edge of the path of the bearing shoes is indicated by arc 24B; the limit of the tubular surface is indicated by 24C; and the outer circumference of the rotor body is indicated by 24D. The drawing shows various radii and geometric relationships for arcs 24A-24D, which will be readily understood by persons of ordinary skill and accordingly further description is neither required nor provided.

Figure 25:
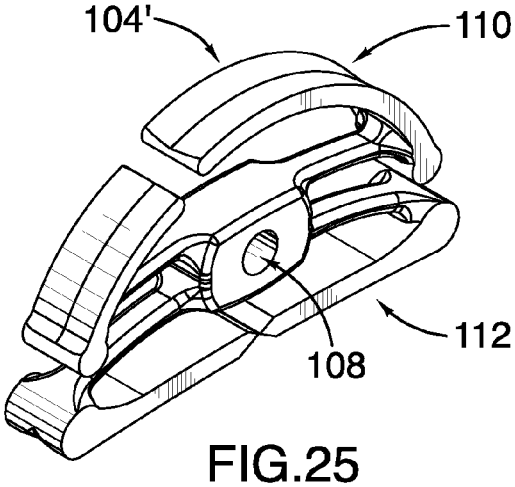
FIG. 25 is a view similar to and showing an alternate embodiment of the structure of FIG. 22.
Figure 25E:
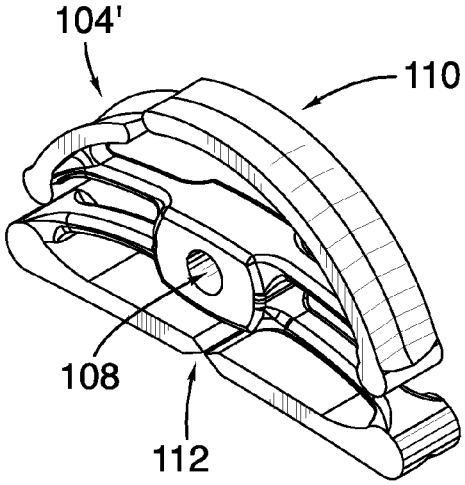
FIG. 25E is another perspective view of the structure of FIG. 25.
Figure 25A:
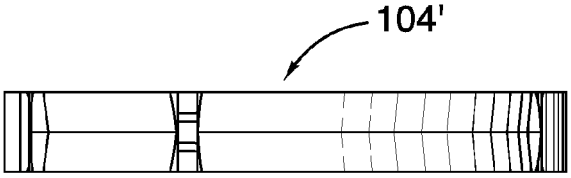
FIG. 25A is a top view of the structure of FIG. 25.
Figure 25B:
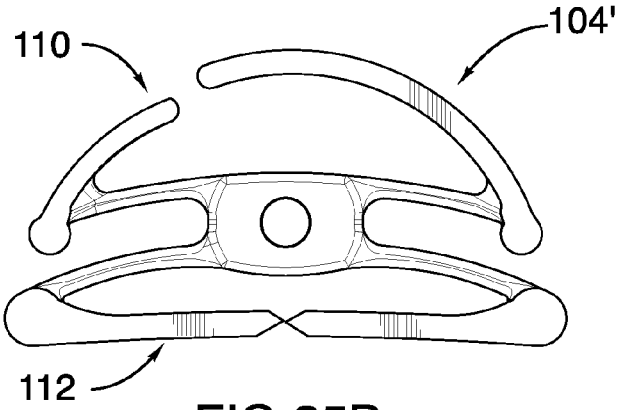
FIG. 25B is a front view of the structure of FIG. 25.
Figure 25D:
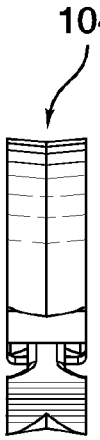
FIG. 25D is an end view of the structure of FIG. 25.
Figure 25C:
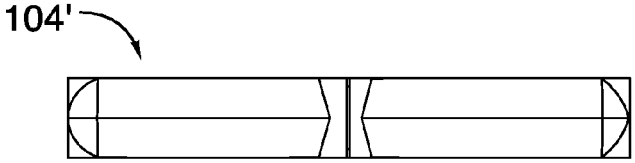
FIG. 25C is a bottom view of the structure of FIG. 25.
Figure 26:
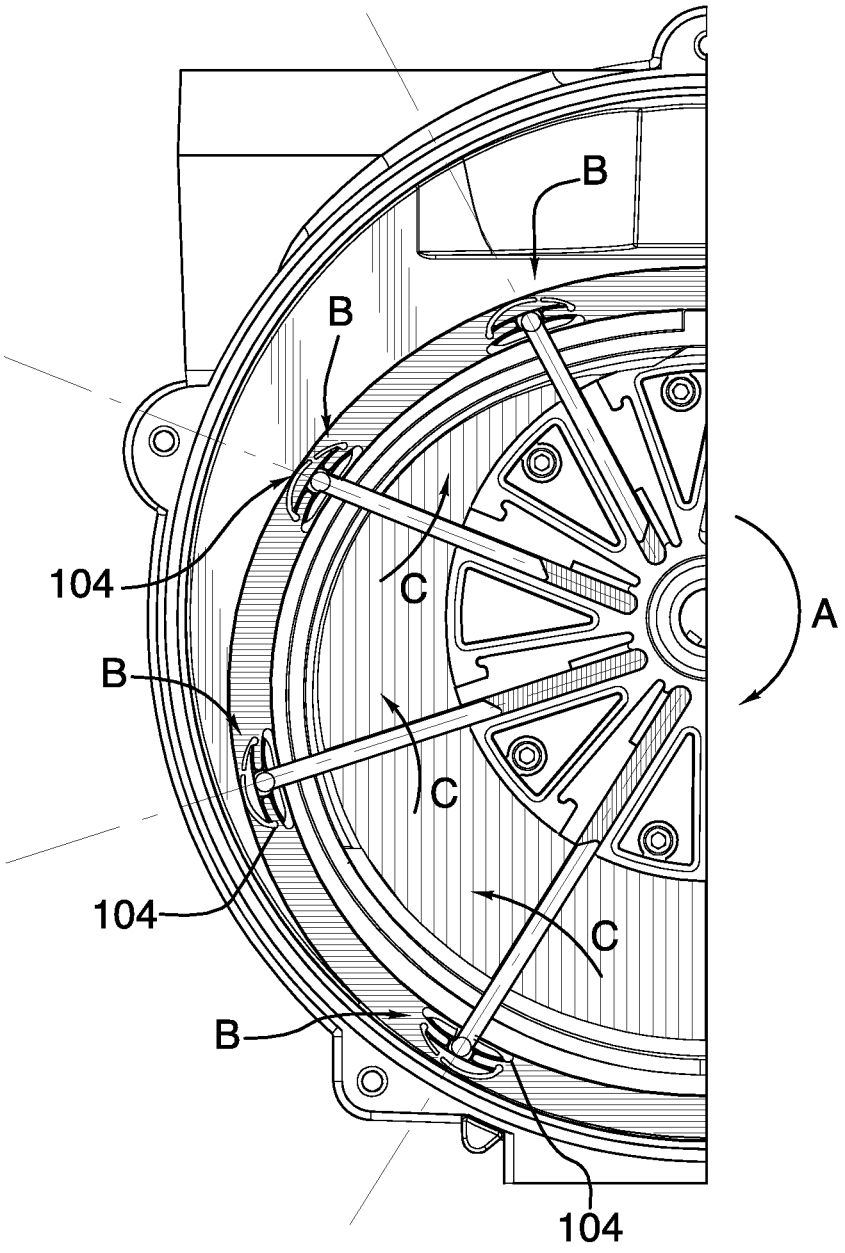
FIG. 26 is an enlarged partial view of the structure of FIG. 20.
Figure 27:
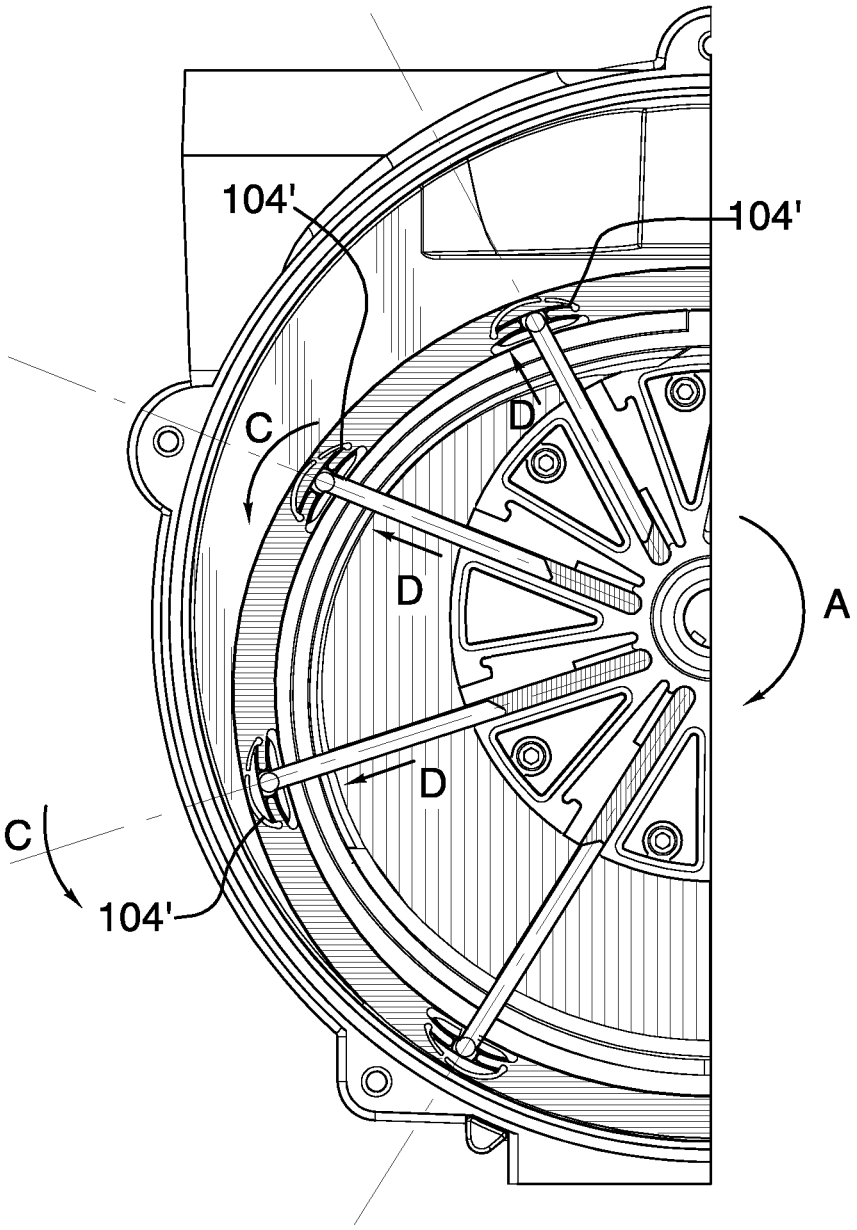
FIG. 27 is a view similar to FIG. 26 showing the structure of FIG. 25 in use.

Yet another variation is shown in FIG. 25. Herein, a variation 104' of the bearing shoe 104 of FIG. 22 is shown. Bearing shoe 104' looks and functions similarly to bearing shoe 104 and thus is labeled accordingly. However, it is speculated that bearing shoe 104' may show improved performance in use. By way of background, reference is made to FIG. 26, which shows a portion of the device of FIG. 20 that includes bearing shoes 104. Arrow A shows the direction of rotation of the rotor. In this rotary device, localized wear has been noticed at the locations indicated by arrows B. Without intending to be bound by theory, this localized wear is believed to be caused, inter alia, by frictional forces that tend to cause bearing shoes 104 to rotate in the direction of arrows C. FIG. 27 shows the structure of FIG. 26, with bearing shoes 104' substituted for bearing shoes 104. Bearing shoes 104' are pre-stressed once positioned in the raceways so as to be relatively more resistant to compression on the trailing side that bearing shoes 104, which is believed will create forces as indicated by arrows D which will counter the rotational forces and minimize localized bearing wear as well as binding.

Figure 28:
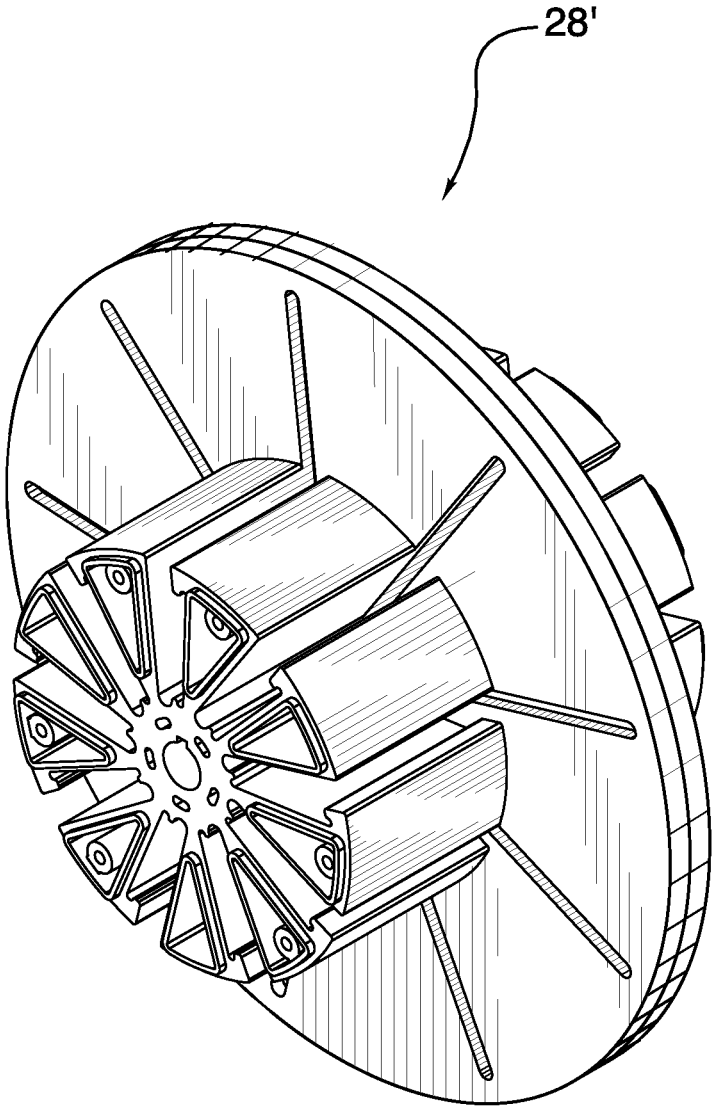
FIG. 28 is a view similar to FIG. 18A showing an alternate embodiment of the structure of FIG. 18A.
Figure 29:
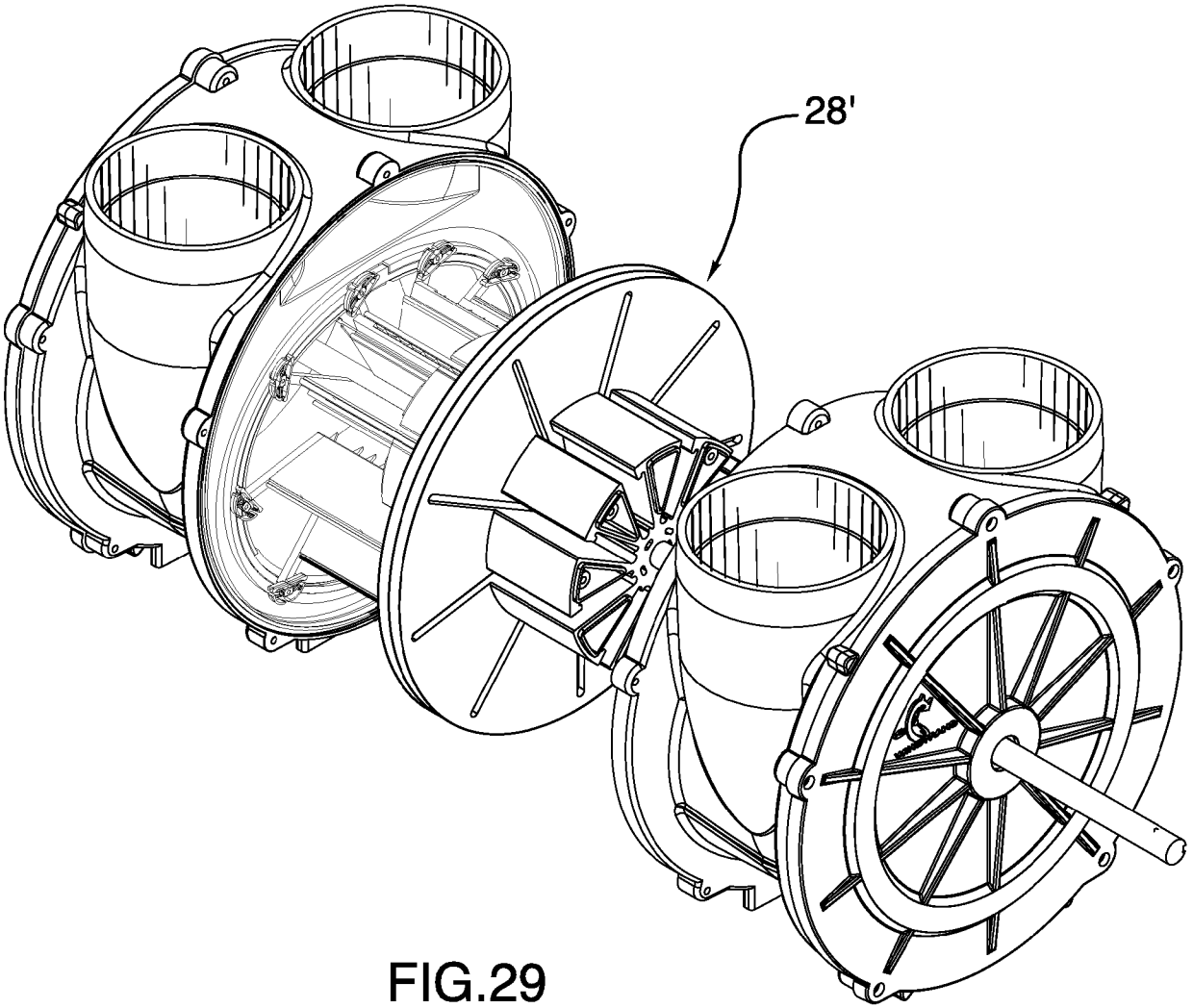
FIG. 29 is a perspective view showing the structure of FIG. 28 in use.
Figure 30:
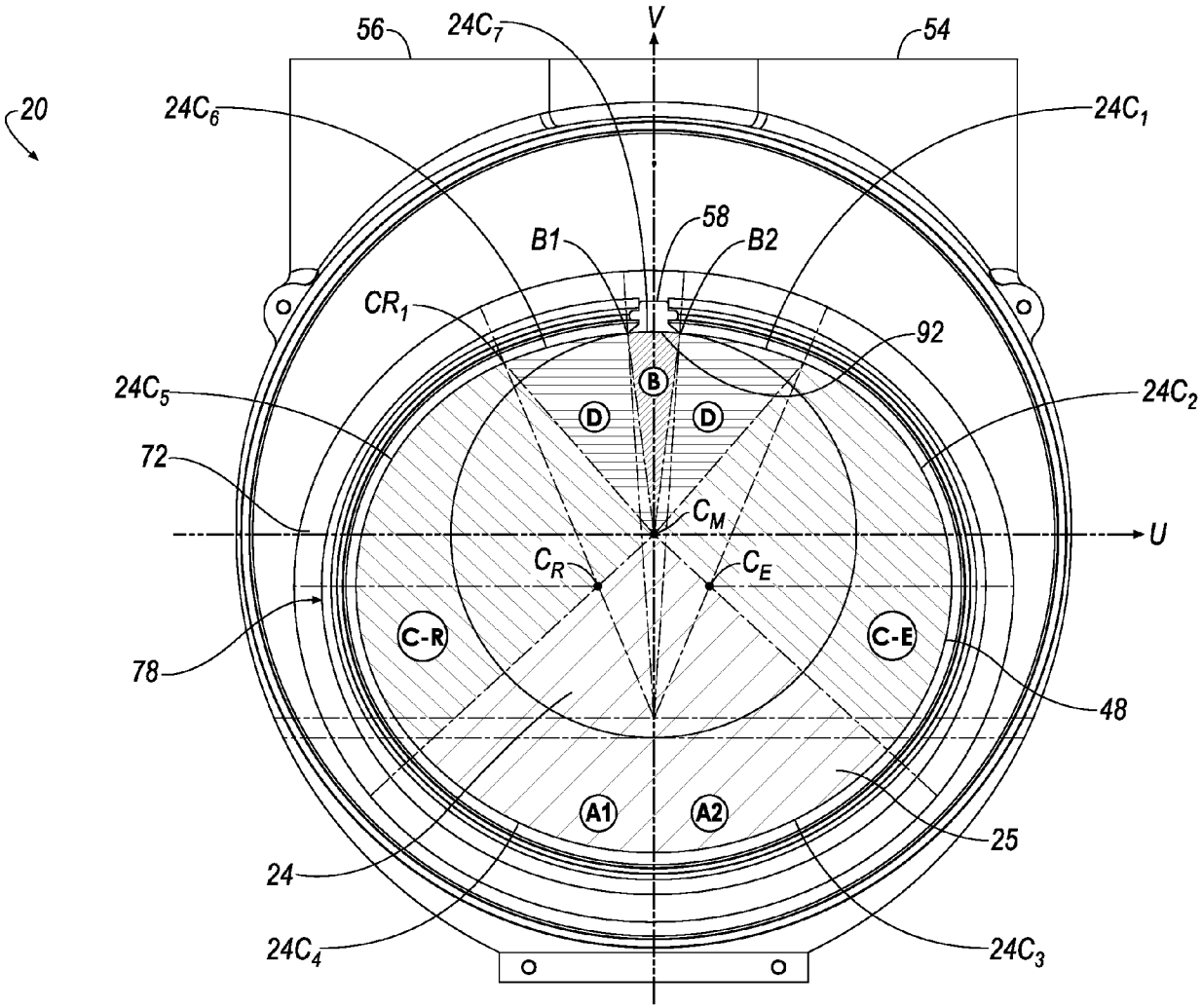
FIG. 30 is a front view of an exemplary rotary device showing the geometric relationships amongst the components.
Figure 31:
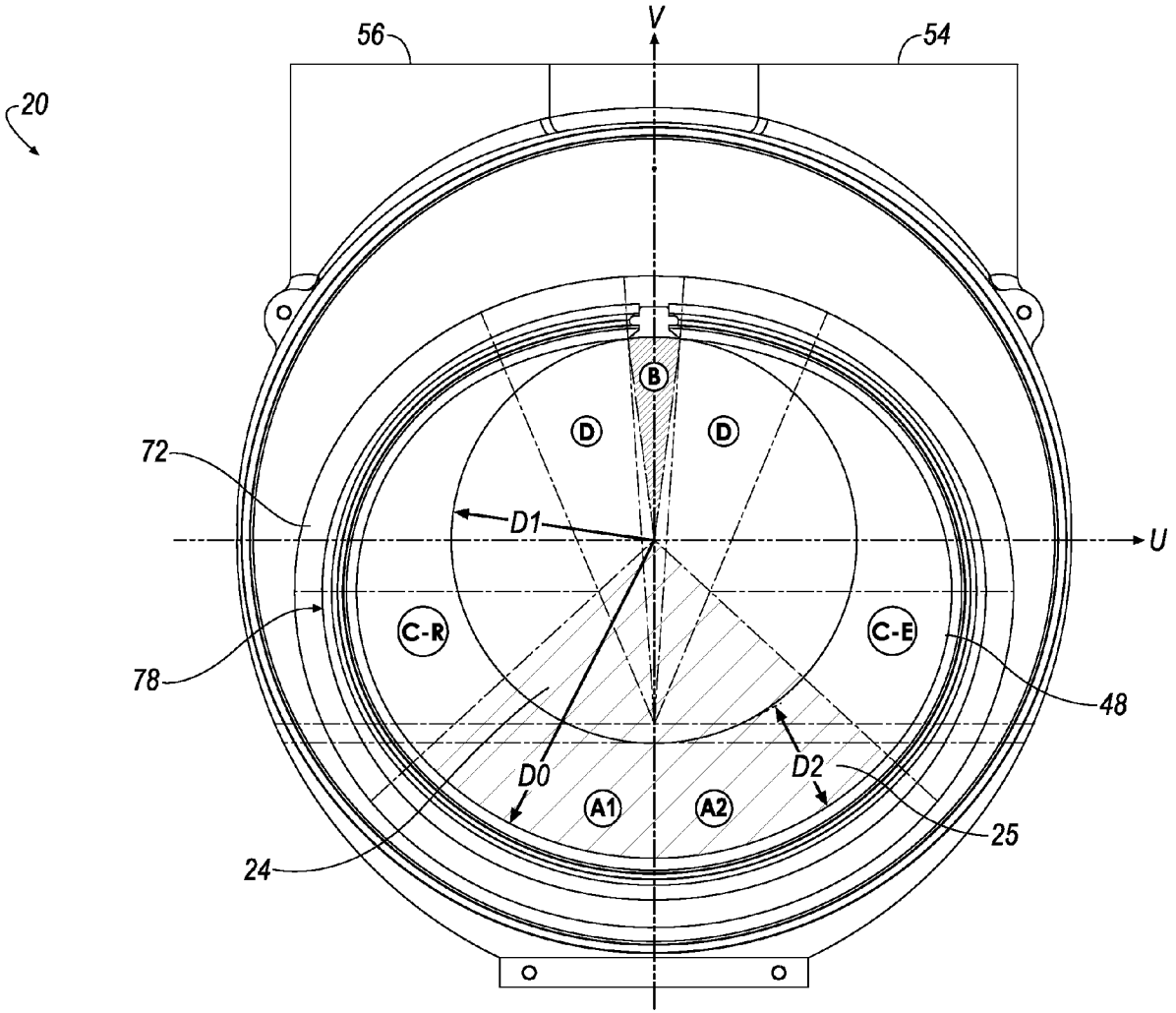
FIG. 31 is a front view of an exemplary rotary device showing the geometric relationships amongst the components.
Figure 32:
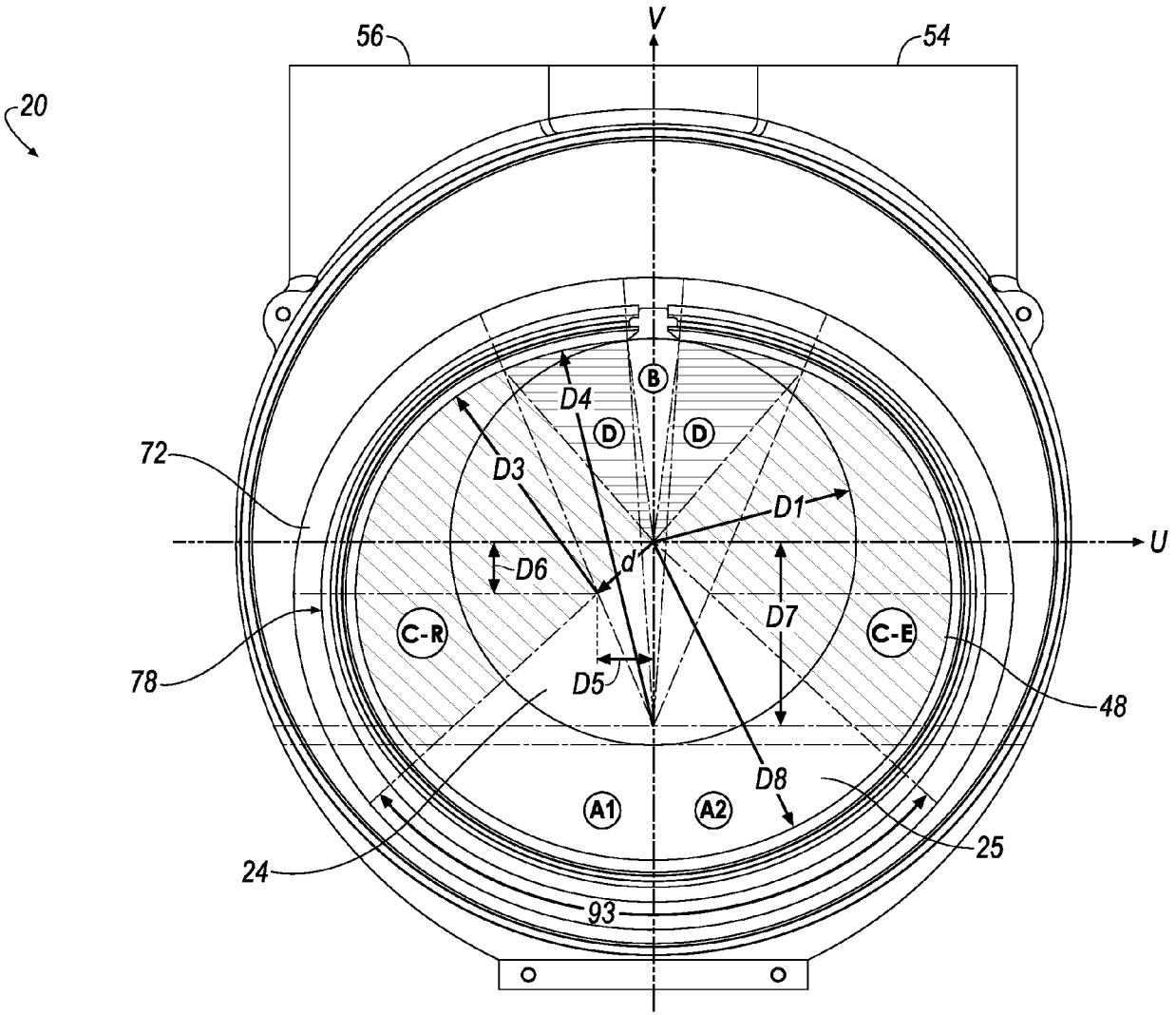
FIG. 32 is a front view of an exemplary rotary device showing the geometric relationships amongst the components.

Yet another variation is shown in FIG. 28, which shows a structure similar to plate 28 of FIG. 18A but having slots defined on both faces therein. Use of plate 28' allows a pair of rotary devices to be ganged upon a common shaft, as shown in FIG. 29, with advantageous impacts in terms of flexibility and manufacturing costs.

Yet another variation is shown in FIGS. 30-36, which show a rotary device 20 (e.g., a pump) having a radius D1, a rotor body 24 rotating within a housing 22. The rotor body having a tubular surface 48 defining in part a tubular volume. The tubular surface 48 is swept by the vanes 26 as the rotor body 24 rotates. The rotor body 24 defines a longitudinal, traverse, and vertical axis U, V, W.

The pump 20 produces pump chambers 25 between two consecutive vanes 26, each pump chamber 25 having a concentric area of operation with the rotor body 24 having a center $C_M$. In some examples, the tubular volume is segregated into at multiple zones or chambers 25. The operation of the pump chambers 25 and the vanes 26 reduce the area of friction during the operation of the pump 20 between the vanes 26 and the tubular surface; therefore, producing a higher mechanical efficiency. During the operation of the pump 20, two or more vanes 26 are in contact with the tubular surface 48 at all times to create a pump chamber 25 and ensure high volumetric efficiency.

The quicker the vanes 26 move in the retraction area of C-R and the delay of the extension area of C-E, greater flow efficiencies or less hydrodynamic losses during operation. The oval raceway 78 may be designed to be as round as possible to the oval tubular surface 48 of the pump 20 yet still allows enough space between the oval raceway 78 and the pump chamber 25 for a seal. The distance between the raceway 78 and the tubular surface 48 is driven by the width of the seal, the seal material used, and the minimum material possible than can be used to support or dam the area between the oval raceway 78, the bridge seal 92, and the pump chamber 25. The shape of the oval raceway 78 is driven to minimize the steepness of the extension arcs C-E and the retraction arc C-R and to still produce the correct timing of the extension and retraction of the vanes 26 relative to the oval chamber of the pump.

In some implementations, the tubular surface 48 has an ovular shape in cross-section having a series of connecting arcs 24$C_1$-24$C_8$ that define the shape of the tubular surface 48. As shown, the pump 20 is operating in a clockwise direction as shown by arrow A; however, the pump 20 may also operate in a counter-clockwise direction opposite to the direction of arrow A. The pump receives a fluid from a first port 54 and outputting the fluid through the second port 56. Each arc 24C forms a pump volume chamber 25. In some implementations, at least one volume chamber 25 is symmetrical with another volume chamber 25 about the U axis. As shown, each pump volume chamber 25 is defined as chambers B, D, C-E, A, C-R. Chamber A, the vane activation area, includes chambers A1 and A2, each having a pie shape and each defined by the radius D8. Radius D8 is the summation of the rotor radius D1 and a distance D2 equals to about 55% to 60% of the radius D1. Therefore, D2 provides arcs 24$C_3$ and 24$C_4$ that are concentric to the circumference 24D of the rotor. Chambers A1 and A2 may have the same shape and may hold the same amount of fluid volume, and therefore are symmetrical about the V-axis.

Chambers A and B are concentric to the center $C_M$ of the rotor body 24. In chamber B, the vanes 26 are fully retracted into the rotor body 24. The radius of area B is equal to the radius of the rotor. The arc length of area B is equal to a minimum of doubling the length of the rotor slot or vane width. This allows the upper seal to bridge beyond the slot opening of the rotor. The arc 24$C_7$ is concentric to the center $C_M$ of the rotor body 24. In some examples, the arc 24$C_7$ is the radius of the rotor D1 plus a minimum clearance of 10 thou inch (0.001 inch). The clearance is considered due to the expansion and contraction of the materials used between the rotor and the pump housing.

Chambers C-E and C-R are the activation/retraction and extension zone within the pump cavity. Chamber C-E is defined by radius D3 and center $C_R$, and chamber C-R is also defined by radius D3 and arc 24$C_2$. In some examples, the arcs 24$C_2$ and 24$C_2$ are equal due to the symmetry of the pump 20 about the V-axis. The center point $C_R$ of arc 24$C_5$ is a distance D5 in the negative direction of the U-axis and a distance D6 in the negative direction of the V-axis. Similarly, the center point of arc 24$C_2$ is a distance D5 in the positive direction of the U-axis and a distance D6 in the negative direction of the Y-axis. D5 and D6 are each equal to 25% to 30% of the rotor radius D1. Once the center point $C_R$ is determined, the radius C3 may be determined by using Pythagoras' theorem. Center point $C_R$ is a distance d from the rotor center $C_M$. Distance d may be determined by the following equation:

$$(D5)^2+(D6)^2=d^2 \quad (1)$$

$$d=\sqrt{(D5)^2+(D6)^2} \quad (2)$$

D3 is therefore equal to D8 minus d. Thus, the arc C-R is determined. Similarly, arc C-E has the same radius D-3 and therefore may be determined. Once the arc 24$C_3$ is determined the area C-E is determined by connecting the center of the rotor $C_R$ with the arc and forming an irregular pie shape.

Camber D forms a transition area between the vane activation chambers A and the upper bridge seal 92. Once areas B, C-R, and C-E, and A are defined, areas D may be defined. Chamber D is drawn by connecting the endpoint B1 of arc 24$C_7$ of camber B to the endpoint C-$R_1$ of arc 24$C_5$ of chamber C-R. The connecting arc 24$C_6$ is approximately 20% to 30% of the distance between chamber A and chamber B. In some examples, the arcs 24$C_1$-24$C_7$ are drawn as tangent to one another as possible.

As the rotor body 24 rotates through the oval shape of the tubular surface along arc 24C, each vane 26 extends and retracts along a translation axis $Y^1$-$Y^1$, $Y^2$-$Y^2$, etc. defined by the slot 66 for which each vane 26 is provided. Each vane 26 includes a track follower 74 that traverses a track 72 and is rigidly connected to each vane 26. The oval track 72 is defines by a pair of oval raceways 78 defined on opposite sides of the housing body 24.

Figure 35:
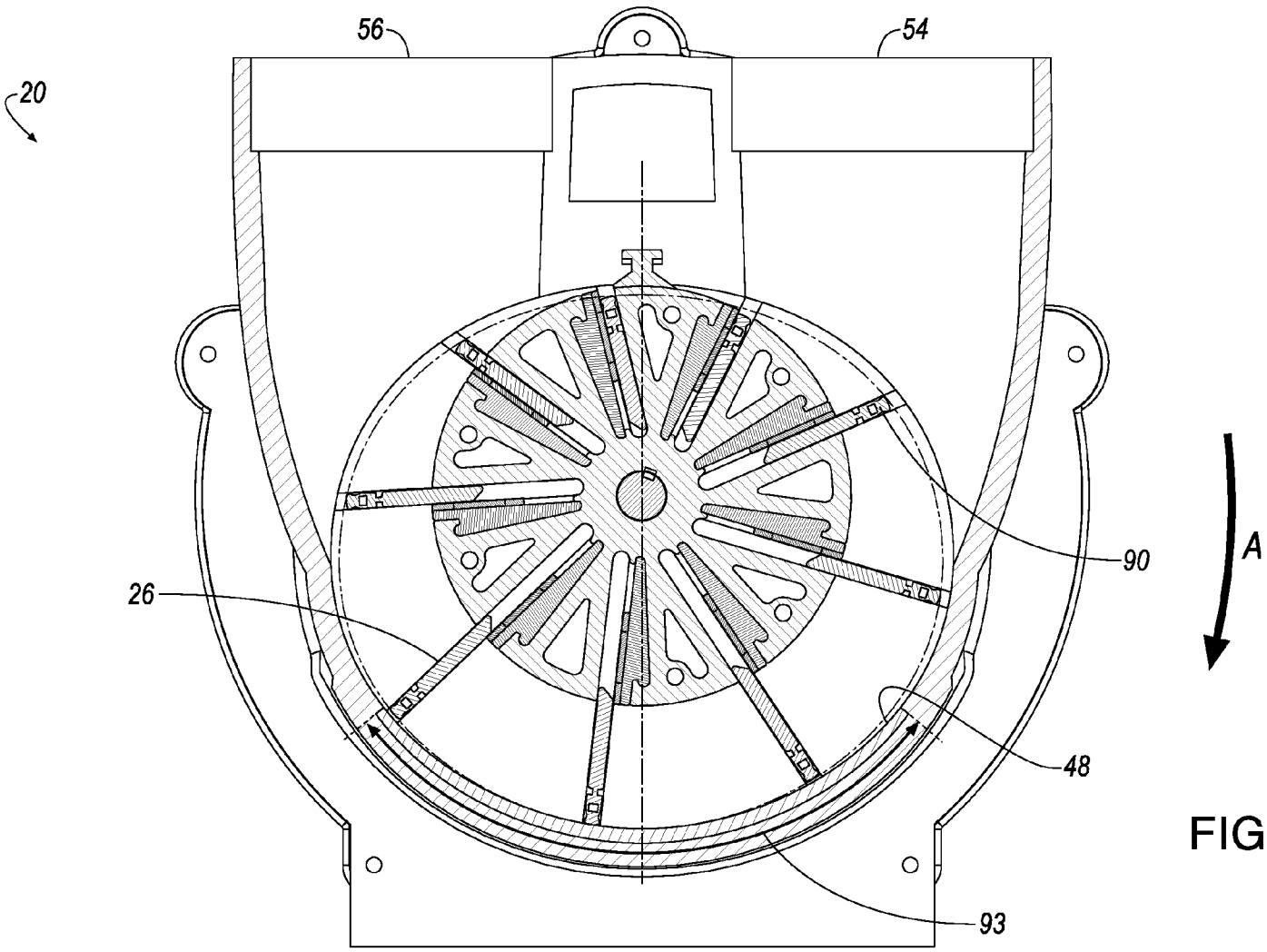
FIG. 35 is a front view of an exemplary rotary device showing the expansion and retraction of the vanes.
Figure 36:
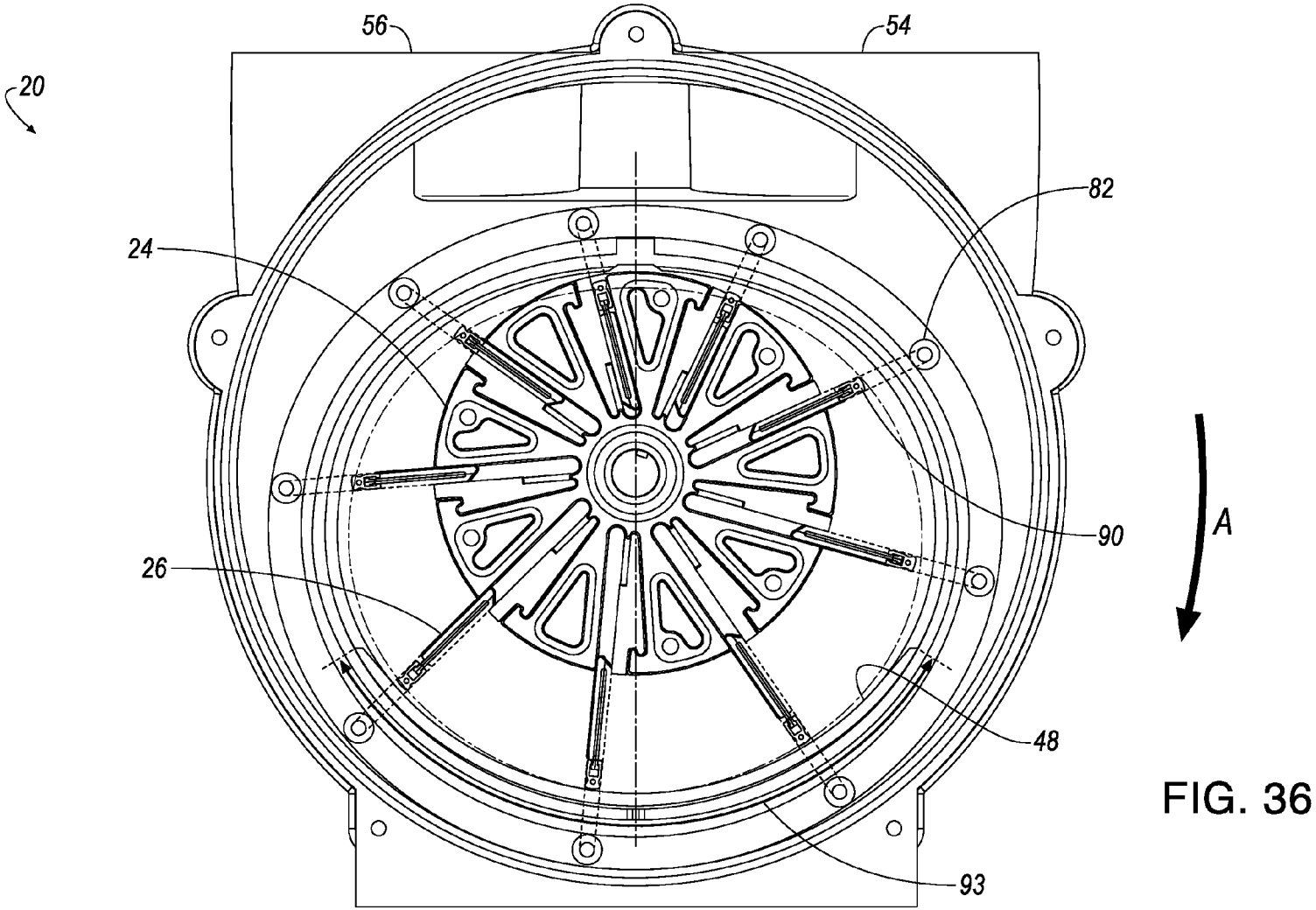
FIG. 36 is a front view of an exemplary rotary device showing the vane path to pump cavity.
Figure 37:
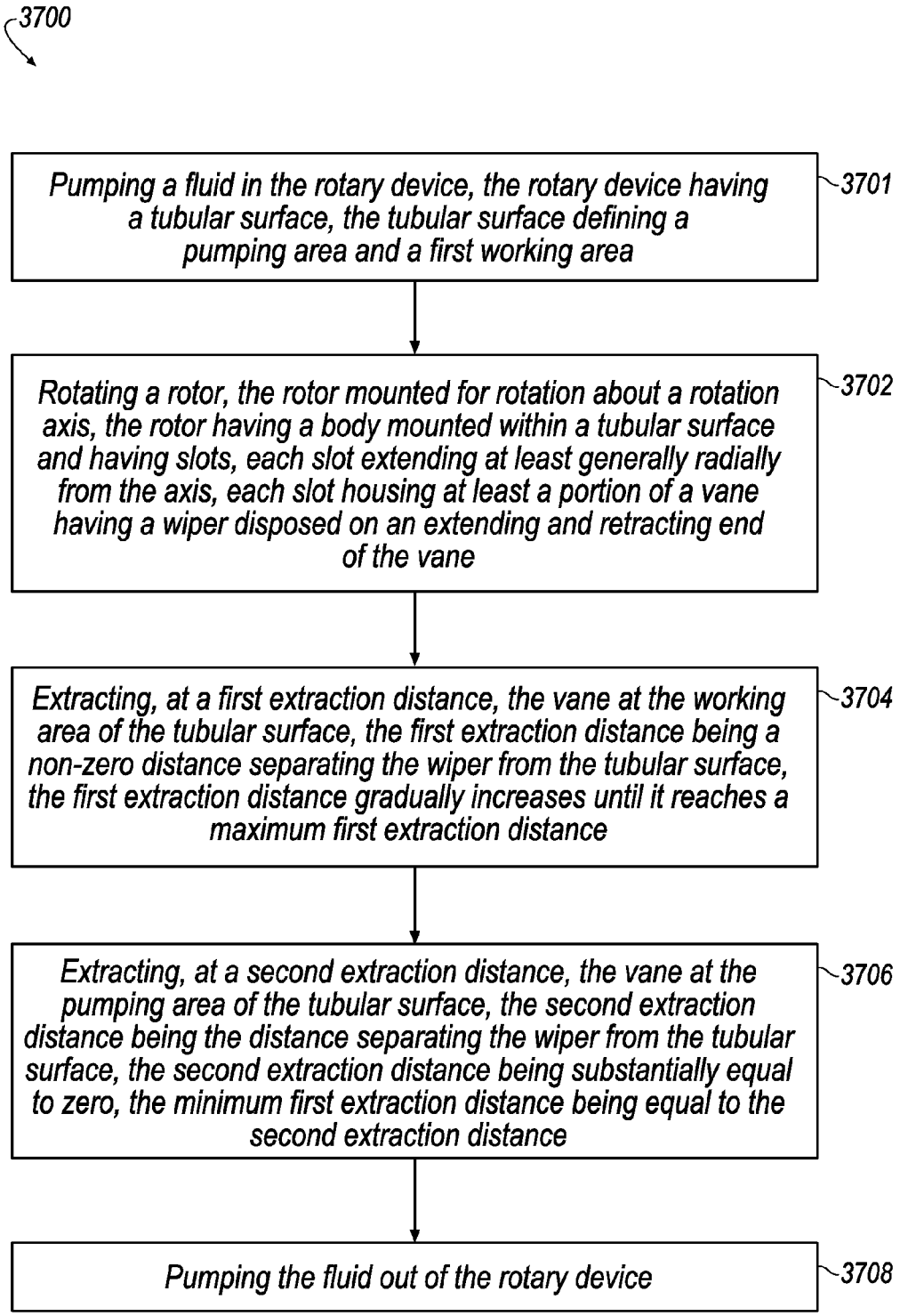
FIG. 37 is a schematic view of an exemplary arrangement of operations for operating the rotary device.
Figure 38:
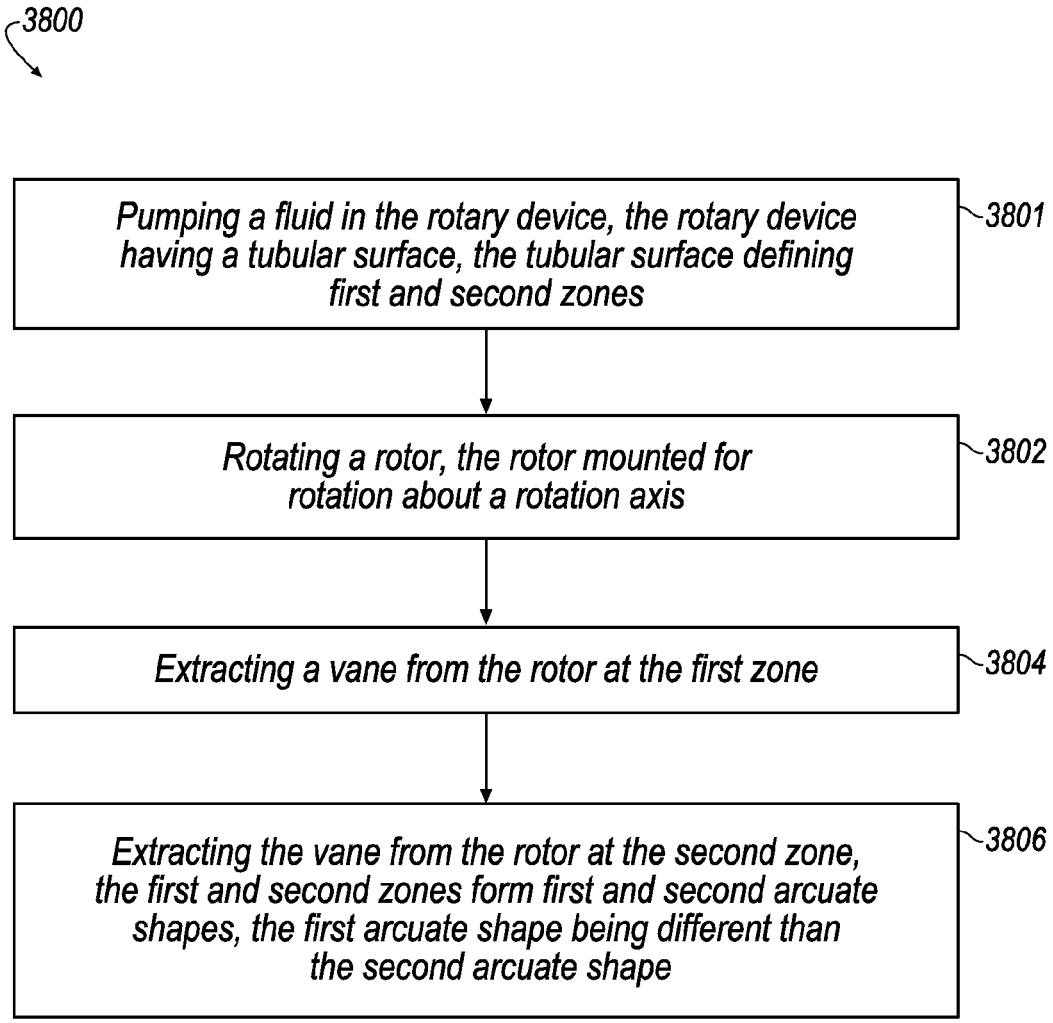
FIG. 38 is a schematic view of an exemplary arrangement of operations for operating the rotary device.

Referring to FIGS. 35 and 36, in some implementations, the track 72 has an ovular shape in cross-section. In some examples, the track 72 has a complementary shape to arc 24C of the tubular surface 48. The track 72 is defined by a pair of raceways 78 defined on opposite sides of the housing body 24. Each raceway 78 has an inner track edge indicated by arc 24B and an outer edge indicated by arc 24A. The inside arc 24B and the outside arc 24A are separated by an equal distance F, and each arc includes a combination of smaller arcs to form an oval shape complementary to the shape of the tubular surface 48. The track width F is determined based on the roller 82 or bearing shoe 104 diameter and the distance of the track 72 that the roller 82 or the bearing shoe 104 will travel. The roller 82 or bearing shoe 104 must be able to ensure that a correct distance for the vane 26 and the wiper 90 to be in contact with the tubular surface 48 to initiate the pump activation. The shape of the track 72 is designed to follow the arc 24$C_3$ of the extension chamber C-E and the arc 24$C_4$ of the retraction chamber C-R. As the pump 20 rotates, the vanes 26 first enter the extension phase as they travel through chamber C-E of the track 72, the track 72 drags the vanes 26 out from the center of the rotor (in the extension or activation area of the track 72). In some implementations, the vanes include a roller 82 or a bearing shoe 104 that allow the vane to traverse the track 72.

Referring back to FIGS. 20-22C and 35, in some implementations, the pump 20 includes a bearing shoe 104. As previously described, the bearing shoe 104 has an upper runner 110 and a lower runner 112 each formed generally in the manner of a leaf spring. The raceways 78 and bearing shoes 104 are designed such that, but for the spring action of the bearing shoes 104, the wipers 90 would be in interference contact with the tubular surface. As the vane 26 traverses the track 72, the upper runner 110 is in contact with the outer edge indicated by arc 24A of the track 72, and the lower runner 112 is in contact with the inner track edge indicated by arc 24B. The upper and lower runner 110,112 may maintain contact with the inner and outer edges of the track 72.

Referring to FIGS. 35 and 36, in some implementations, the pump 20 includes a roller 82. In the extension area, the roller 82 rides along the inner arc 24B of the track 72. The track width F and the radius of the roller 82 forces the vane 26 and the wiper 90 at the correct time to touch the tubular surface 48 of area A and therefore enabling sealage. As previously discusses, the arc 24$C_3$, 24$C_4$ of area A is concentric with the center $C_M$ of the rotor body 24. Additionally, and to ensure that the wiper 90 is in continuous contact with the tubular surface 48 and does not break the seal as it is traveling though the arcs 24$C_3$, 24$C_4$ of chamber A, the track 72 in chamber A is also concentric to the center $C_M$ of the rotor. As the vane 26 traverses chamber A, the roller 82 is centered in the concentric track 72 reducing friction or drag on the roller 82 and allowing a distance for the roller 82 to stop and change direction of rotation before being initiated into the retraction area C-R of the pump 20. Therefore, as the vane 26 traverses the track 72 beginning from area B, the roller 82 is initially riding the inner arc 24B of the track 72 in area C-E, when the vane reaches area A the roller 82 is centered between the inner arc 24B and the outer arc 24A, and finally as the vane approaches area C-R the roller 82 is riding towards the outer arc 24A.

Referring back to FIGS. 30-36, as the roller 82 or the bearing shoe 104 travel through the track 72, the wiper 90 follows a path 24E having variable distances between the wiper 90 and the tubular surface 48. As shown, the wiper 90 is at a distance from the inner tubular surface 48 when the vanes 26 are traveling through chambers B, D, C-E, and C-R. However, when the vanes 26 are traveling through chamber A, the wiper 90 touches the tubular surface and creates a seal to avoid leakage from chamber A.

Figure 34B:
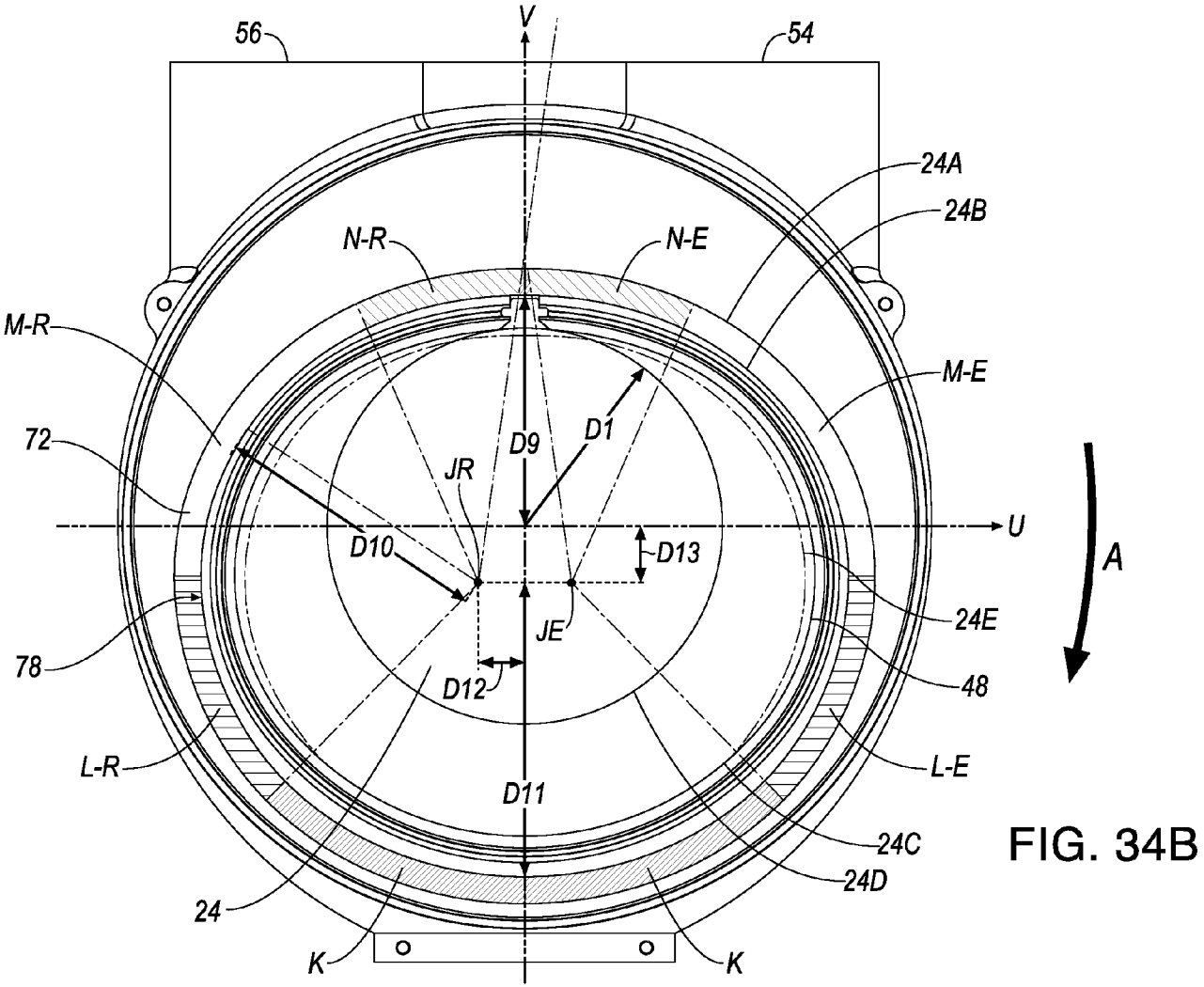
FIG. 34B is a perspective view of an exemplary vane assembly.

In some implementations, the track width F has a constant length through the track 72. The track 72 is constructed of multiple pairs of arcs, each arc within the pair of arcs separated by the width F. The inner arc 24B and the outer arc 24A are therefore separated by distance F. Therefore, by defining one of the inner arc 24B or the outer arc B, the other arc may be defined. The track 72 is separated from the tubular surface 48 by a variable distance E, which is the distance from the inner arc 24B to the tubular surface 48. Referring to FIG. 34, in some implementations the minimum distance of $E_{min}$ is at the bridge seal 92 here the track 72 is the closes to the pump cavity. The minimum distance of $E_{min}$ equals about 55% to 65% of the distance from the tip of the rotor to the outer arc 24A. A vane activation distance D14 (FIG. 34B) is defined as the distance between the roller 82 or the bearing shoe 104 and the wiper 90. The greater the vane activation distance D14 the farther away the vane 26 is to the pump chamber 25. The shorter the vane activation distance D14 the closer the wiper 90 is to the tubular surface 48 of the pump chamber 25.

Figure 33:
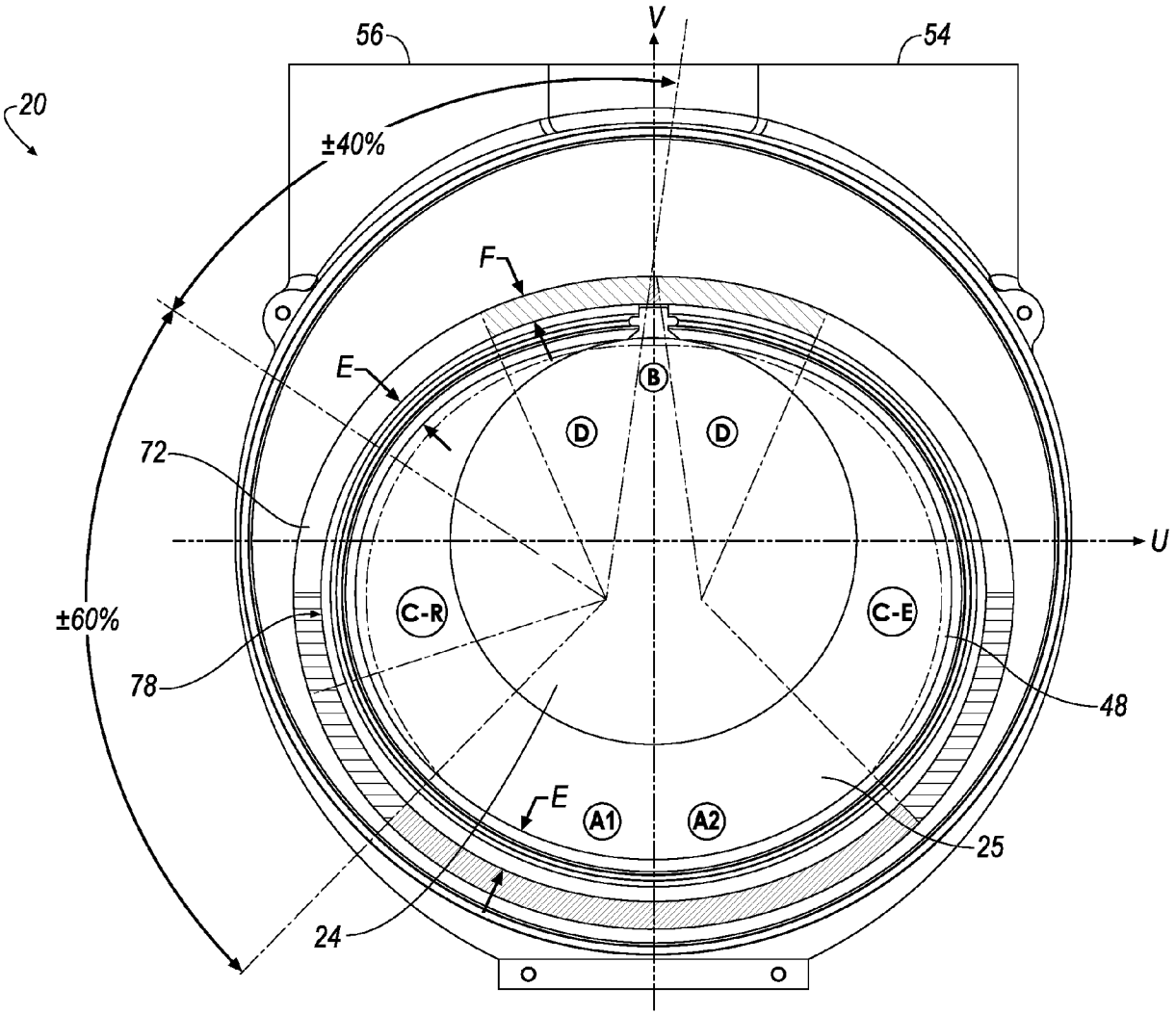
FIG. 33 is a front view of an exemplary rotary device showing the geometric relationships amongst the components.

Referring to FIG. 33, in some examples, the maximum movement of the track 72 to the center of the pump $C_M$ is at the 60% mark of its travel through the chambers C-R and C-E. This ensures that the vane 26 has moved as quickly as possible but is still providing a more rounded sweep so that the travel is not steep. The last 40% of the travel through the track 72 ensures that there is enough time to change the radius in order to join the concentric to the center rotor body 24 at the top seal 92 of the pump 20 at the chamber B. Since the shape of the tubular surface might be varied, the 40% and 60% might be changes. In some examples, a more ovular shaped tubular surface may require that the maximum movement of the cam path be set at 65%, where a more rounded tubular surface 48 may require that the maximum movement of the track 72 to be at 55%.

Figure 34A:
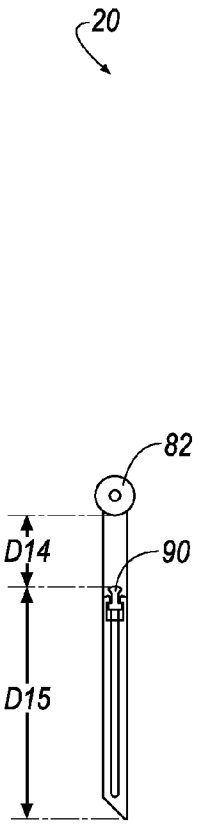
FIG. 34A is a front view of an exemplary rotary device showing the geometric relationships amongst the components.

Referring to FIGS. 34A, 34B, a radius D16 is the radius of arc K. Since arc K is concentric with arc A, both arcs share the same center $C_R$ which is the rotor center. The radius of the arc K is equal to the radius of arc A which is D8 plus the distance $E_{max}$ which is a maximum value of E, being constant within area K.

The track 72 defines areas L-R, M-R, and N-R that force the vanes 26 to retract into the rotor body 24. In addition, the track 72 defines areas L-E, M-E, and N-E that force the vanes 26 to extract from the rotor body 24.

D12 and D13 are distances driven by the van activation distance D14 to allow retraction and extraction of the vane during the travel of the vane 26 to and from the pumping zone 93 of the pump and full depression at the top of the pump rotor. D12 and D13 are found by taking 100% to 110% of D14. The distances of D12 and D13 ensures that during operation of the pump 20 the top two thirds of the pump 20 has the ability to push the vanes 26 into the rotor body 24 without causing interference with the wiper 90 is to the tubular surface 48. The vane activation distance D14 is critical within chamber A during the pumping area because the vane activation distance D14 should be large enough so as not to be over stressed by the distance between the inner arc 24B of the track 72 and the tubular surface 48 along chamber A, but not too large as to cause leakage in chamber A (the pumping zone) or bottoming out into the outer arc 24A of the track 72. As previously discussed, the roller 82 or the bearing shoe 104 are centered within the track 72 at zone A.

When distances D12 and D13 are determined, the center $J_R$ and $J_E$ may be found by going a distance D12 in the negative direction of the U-Axis and distance D13 in the negative direction of the V-axis. Therefore, radius D10 of arc L-R and M-R may be determined by drawing an arc having a center $J_R$ and radius D10 and beginning at a point where the area K ends. Similarly arc L-E and M-E may be drawn. As for areas N-R an arc connecting areas M-R and the top portion of the arc 24A is drawn, and N-E an arc connecting M-E and the top portion of the arc 24A is drawn.

The arc of the track 72 is drawn to complement the path 24E of the wiper 90. In some examples, the shape of the path of the track 72 is more rounded than the ovular shape of the tubular surface. The difference in shape between the path of the track 72 and in tubular surface creates the variation in the variable distance E. The arcs forming track 72 should be as tangent to one another as possible.

D9 is the distance that ensures full depression of the vane 26 into the rotor body 24. Therefore, D9 equals to the rotor radius D1 and the distance between the roller 82 or the bearing shoe 104 and the wiper 90 (i.e., the vane activation distance D14).

D11 is the concentric area of the pump cavity and ensures that the space between the rotor body 24 and chamber A of the pump 20 stay the same, thus eliminating hydraulic issues. The distance D11 is found by adding D14 with 90% to 95% of D15. This will provide 5% to 10% of the vane length D15 to stay within the rotor slot during operation; this gives the vane 26 longitudinal support over the length of the rotor. Area K may be concentric to the rotor and to area A. In some examples, area K spans a distance of 25% to 30% of the overall rotation of the pump 20 to ensure that a minimum of 2 to 3 vanes 26 are always in contact with the tubular surface during rotation of the rotor body 24.

In some implementations, the first arc of L-R or L-E is draws starting at the end of the arc of area K and extends approximately 45% to 55% up the track 72. The second arc of M-R or M-E is drawn to connect L-R or L-E and is carried about 75% to 80% up along the track 92. Arcs N-R and N-E are drawn to connect at the top of the bridge seal 92 that is concentric to the rotor body 24 at the area having D9 as a radius.

In some examples, the track path 72 is drawn using the shape of the tubular surface 48 and/or the path 24E of the wiper 90 as a reference. The oval shape of the tubular surface 48 may be rounded to accommodate the track 72 and reducing the steep areas in the track 72 that are found in the tubular surface 48. Additionally, the difference in shape between the track 72 and the tubular surface 48 may provide the correct timing to ensure activation and deactivation of the vanes 26 in chamber A (the pumping area 92 of the pump 20). The discrepancy in shape allows for the pull/pushing the vane 26 and the wiper from/towards the tubular surface 48 as it travels the track 72. This provides for a greater fluid efficiency or less hydrodynamic losses during operation of the pump 20. When the vane 26 is pulling away from the tubular surface 48, the pump chamber allows the wiper 90 to leak back or giving it head pressure back to the following vane that is in operation in the pumping area 93. The removal of this pressure on the vane 26 allow the vane 26 to move freely with less friction and ware on vane components also providing great mechanical efficiency during operation of the pump 20 producing a more energy efficient pump.

Additional benefits of the geometry of the pump as described, include:

1) Improving the capabilities of the pump 20 in comparison to the current industry standards due to the pump sealing capabilities at low RPM and the smooth rotary action with the vanes 26 that retract from the rotor body 24 at an earlier time, and are delayed when extending from the rotor body 24. These features reduce heat vibration and agitation to the fluid being rimed or lifted from the surface of the fluid supply to the inlet and though the pump 20, leading to stopping of cavitation in the pump 20.

2) The controlled extension and retraction of the vanes 26 allow the pump turbine or motor inlet and outlet to be shaped and angled for inline flow in and out with piping reducing turbulence kinetic energy and improving velocity of fluid through pump. Additionally, the shaping and angling of inlet and outlet will also eliminate the need of elbows and the efficiency loss related to the elbows to bring the pumping in line with the flow.

3) The track 72 controls the movement of the vanes 26 to extend and retract from the rotor body 24. The shape of the track 72 allows the use of three or more vanes 26 locked in position and working at the same time, thus reducing leakage or improving volumetric efficiency. The reduced leakage allows the pump 20 to work efficiently at very low RMP. In addition, the capability of multiple vanes 26 in pumping zone 93 (i.e., when the wiper 90 is in contact with the tubular surface) will share the pressure or load between multiple vanes 26 increasing the strength or pressure capabilities of the vanes 26.

4) The shape of the track 72 makes the vanes 26 retract into the rotor body 24 away from the tubular surface 48 early in the rotation and extend the vane 26 from the rotor body 24 late in the rotation and still maintain limited steepness or change of angle in the track 72.

5) Additionally, the early vane 26 retraction and late vane 26 extension control in the rotor rotation allows the inlet 54 and outlet 56 to be shaped and angled for inline flow with piping in and out this also reduces turbulence kinetic energy and improving velocity of the fluid through device.

6) These turbulence and velocity results combined with low RPM efficiencies minimized shearing blending and heat to the flow do increase priming and lifting capabilities of the pump.

Another aspect of the disclosure provides a method 3700 of operation of a rotary device 20 (e.g., pump). The method 3700 includes pumping 3702 a fluid in the rotary device 20. The rotary device 20 has a tubular surface 48 defining in part a tubular volume. The tubular volume defines a pumping zone 93 and a first working zone D, C-E. The method 3700 also includes rotating 3702 a rotor body 24. The rotor body 24 is mounted for rotation about a rotation axis X-X and within a tubular surface 48. The rotor body 24 includes slots 66 where each slot 66 extends at least generally radially from the axis X-X. In addition, each slot 66 houses at least a portion of a vane 26 having a wiper 90 disposed on an end of the vane 26. The method 3700 also includes extracting 3704, at a first extraction distance, the vane at the working zone D,C-E of the tubular surface 48. The first extraction distance is a non-zero distance that separates the wiper 90 from the tubular surface 48. The method 3700 also includes extracting 3706, at a second extraction distance, the vane 26 at the pumping zone 93 of the tubular surface 48. The second extraction distance is the distance separating the wiper 90 from the tubular surface 48 and is substantially equal to zero. The method 3700 includes pumping 3708 the fluid out of the rotary device 20. The first extraction distance gradually increases until it reaches a minimum first extraction distance, the minimum first extraction distance being equal to the second extraction distance.

In some examples, during extracting 3704, at the first extraction distance, the wiper 90 is separated from the tubular surface 48 by a variable distance. The variable distance decreases as the first extraction distance increases and the vane 26 approaches the pumping zone 93. The method 3700 may further include retracting, at a first retraction distance, the vane 26 at a second working zone C-R, D adjacent the pumping zone 93. The first retraction distance is the distance that separates the wiper 90 from the tubular surface 48. Additionally or alternatively, the method 3700 may further include sealing the fluid to flow into and out of the rotary device 20 substantially only through an input port 54 and an output port 56.

Another aspect of the disclosure provides a method 3800 of operation of a rotary device 20 (e.g., pump). The method 3800 includes pumping a fluid in the rotary device 20 (e.g., a pump). The rotary device 20 has a tubular surface 48 that defines a first zone D, C-E and a second zone A. The method 3800 also includes rotating 3802 a rotor body 24 mounted for rotation about a rotation axis. In addition, the method 3800 includes extracting 3804 a vane 26 from the rotor body 24 at the first zone D, C-E, and extracting 3806 the vane 26 from the rotor body 24 at the second zone A. The first zone A and the second zone D, C-E form first and second arcuate shapes, the first arcuate shape $24C_2$ being different than the second arcuate shape $24C_{3-4}$.

In some examples, the rotor has a body 24 mounted within a tubular surface 48 and has slots 66. Each slot 66 extends at least generally radially from the axis X-X and houses a vane 26. Each vane 26 has a wiper 90 disposed on an extending and retracting end of the vane 26. The wiper 90 contacts the tubular surface 48 of the second zone D, C-E. In addition, the wiper 90 is at a distance greater than zero from the tubular surface 46 of the first zone D, C-E. Additionally or alternatively, the method 3800 may include sealing 3800 the fluid to flow into and out of the rotary device substantially only through an input port 54 and an output port 56.

A number of implementations have been described. Nevertheless, it will be understood that various modifications may be made without departing from the spirit and scope of the disclosure. Accordingly, other implementations are within the scope of the following claims.

What is claimed is:

1. A rotary device for use with a fluid, the rotary device comprising:

a housing having a tubular surface defining, in part, a tubular volume, the housing segregated into at least a pumping zone positioned between first and second working zones, the first working zone configured to receive a fluid and the second working zone configured to output the fluid, the tubular volume defined, in part, by a series of connecting arcs that define, in cross-section, at least a portion of the tubular volume as an ovular shape along the pumping zone and the first and second working zones;

a rotor mounted for rotation about a rotation axis, the rotor having a body mounted within the tubular volume and having a plurality of slots, each slot extending radially from the rotor rotation axis, the tubular volume within the pumping zone has a pumping zone radius being a summation of a rotor radius of the rotor and a distance being 55% to 60% of the rotor radius;

a track defined in the housing, wherein the track is at least partially ovular, and wherein the ovular portion of the track has a shape that differs from the shape of the ovular portion of the tubular volume;

each slot including a respectively associated vane, as the rotor rotates, each vane rotates within the tubular volume and extends and retracts within the tubular volume;

a wiper disposed on an end of each respectively associated vane; and each vane includes a respectively associated track follower connected to the vane, each track follower sized to engage and traverse the track, wherein a spacing (E) between the track and the tubular surface of the housing controls a distance between the wiper and the tubular surface of the housing.

2. The rotary device of claim 1, wherein as each vane approaches the pumping zone, the distance between the wiper and the tubular surface of the housing decreases reaching zero at the beginning of the pumping zone, and the distance between the wiper and the tubular surface of the housing increases as each vane leaves the pumping zone.

3. The rotary device of claim 1, wherein the spacing (E) is at a maximum in the pumping zone.

4. The rotary device of claim 3, wherein the spacing (E) varies in magnitude within, at least a portion of, the first and second working zones.

5. The rotary device of claim 4, wherein the magnitude of the spacing (E) in the pumping zone is substantially constant.

6. The rotary device of claim 1, wherein each vane extends and retracts along a translation axis defined by the slot for which each vane is provided, the translation axis being offset from the rotation axis such that when a fluid pressure on a leading and trailing surface of the vane is not equal, each vane is oriented substantially perpendicular to a direction of fluid flow.

7. The rotary device of claim 1, wherein the vanes reach a maximum extraction distance in the pumping zone.

8. The rotary device of claim 1, further comprising:

first and second ports, the first port for receiving a fluid and the second port for delivering the fluid; and a seal allowing the fluid to flow into and out of the rotary device substantially only through the first and second ports.

9. The rotary device of claim 1, wherein adjacent vanes, the rotor, and the tubular surface define a pump volume.

10. The rotary device of claim 9, wherein when at least two adjacent track followers engage and traverse the track throughout the pumping zone, the pump volume, defined by two vanes associated with the two adjacent track followers, is constant.

11. The rotary device of claim 1, wherein a radius of curvature of the pumping zone is different than a radius of curvature of the first or second working zone.

12. The rotary device of claim 1, wherein the wiper contacts the tubular surface of the housing while the respectively associated vane rotates through the pumping zone.

13. The rotary device of claim 1, wherein the wiper does not contact the tubular surface of the housing while the respectively associated vane rotates through the working zone.

14. The rotary device of claim 1, wherein the housing defines a longitudinal axis, at least one arc from the series of connecting arcs is symmetrical with another arc from the series of connecting arcs about the longitudinal axis.

15. The rotary device of claim 1, wherein the rotor has a center that is coincident with a center of the pumping zone.

16. The rotary device of claim 1, wherein in the pumping zone, the track has a track center concentric with a rotor center of the rotor and a pumping zone center of the pumping zone, and a radius of the track being greater than a radius of the tubular surface.

17. The rotary device of claim 16, wherein the track comprises an inner track and an outer track, the inner and outer tracks separated by a constant distance and configured to provide a path for the track follower.

18. The rotary device of claim 1, wherein the track is defined, in part, by a series of connecting track arcs.

19. A rotary device for use with a fluid, the rotary device comprising:

a housing having a tubular surface defining, in part, a tubular volume, the housing segregated into at least a pumping zone positioned between first and second working zones, the first working zone configured to receive a fluid and the second working zone configured to output the fluid, the tubular volume defined, in part, by a series of connecting arcs that define, in cross-section, at least a portion of the tubular volume as an ovular shape along the pumping zone and the first and second working zones;

a rotor mounted for rotation about a rotation axis, the rotor having a body mounted within the tubular volume and having a plurality of slots, each slot extending radially from the rotor rotation axis, the tubular volume within the first working zone has a working zone radius, the working zone radius having a working zone center not coincident with a center of the rotor, the working zone center has a relative position from the center of the rotor, the relative position being a first distance in a horizontal direction from the center of the rotor and a second distance in a vertical direction from the center of the rotor;

a track defined in the housing, wherein the track is at least partially ovular, and wherein the ovular portion of the track has a shape that differs from the shape of the ovular portion of the tubular volume;

each slot including a respectively associated vane, as the rotor rotates, each vane rotates within the tubular volume and extends and retracts within the tubular volume;

a wiper disposed on an end of each respectively associated vane; and each vane includes a respectively associated track follower connected to the vane, each track follower sized to engage and traverse the track, wherein a spacing (E) between the track and the tubular surface of the housing controls a distance between the wiper and the tubular surface of the housing.

20. The rotary device of claim 19, wherein each of the first distance and the second distance equals 25% to 30% of a radius of the rotor.

21. The rotary device of claim 20, wherein the working zone radius is determined by:

$$D_{W2}=D_{P2}-\sqrt{(D1)^2+(D2)^2};$$

where $D_{WZ}$ is the working zone radius, $D_{PZ}$ is a pumping zone radius of the pumping zone, D1 is the first distance, and D2 is the second distance.

* * * * *